US005602334A

United States Patent [19]

Proett et al.

[11] Patent Number: 5,602,334

[45] Date of Patent: Feb. 11, 1997

[54] WIRELINE FORMATION TESTING FOR LOW PERMEABILITY FORMATIONS UTILIZING PRESSURE TRANSIENTS

[75] Inventors: Mark A. Proett; Margaret C. Waid, both of Houston, Tex.

[73] Assignee: Halliburton Company, Houston, Tex.

[21] Appl. No.: 261,512

[22] Filed: Jun. 17, 1994

[51] Int. Cl.[6] ..... E21B 49/00; E21B 49/10

[52] U.S. Cl. ..... 73/152.05

[58] Field of Search ..... 73/155, 151, 152; 166/10, 250, 284

[56] References Cited

U.S. PATENT DOCUMENTS

| | | | |
|---|---|---|---|
| 4,745,802 | 5/1988 | Purfurst | 73/155 |
| 4,843,878 | 7/1989 | Purfurst et al. | 73/155 |
| 4,879,900 | 11/1989 | Gilbert | 73/155 |
| 4,890,487 | 1/1990 | Dussan V. et al. | 73/155 X |
| 5,056,595 | 10/1991 | Desbrandes | 73/155 X |
| 5,233,866 | 8/1993 | Desbrandes | 73/155 |

OTHER PUBLICATIONS

M. Waid, M. Proett, R. Vasquez, C. Chen, W. Ford, *Interpretation of Wireline Formation Tester Pressure Response with Combined Flowline and Chamber Mud Supercharging and Mud Invasion Effects,* Society of Professional Well Log Analysts, 34th Annual SPWLA Symposium, Oklahoma City, Jun., 1992.

M. Waid, M. Proett, C. Chen, W. Ford, SPE 22754 *Improved Models for Interpreting the Pressure Response of Formation Testers,* Society of Petroleum Engineers, 66th Annual Technical Conference, Dallas, Texas, Oct. 6–9, 1991.

M. Soliman, K. Petak, *Method analyzes pressure for short flow times;* Oil & Gas Journal, Apr. 30, 1990, pp. 49–54.

K. Petak, R. Prasad, L. Coble, SPE 21832, *Surge Test Simulation;* Society of Petroleum Engineers, Rocky Mt. Regional Mtg & Low Permeability Symp., Denver, Co., Apr. 15–17, 1991.

M. Soliman, SPE 10083, *New Techniques for Analysis of Variable Rate or Slug Test,* Society of Petroleum Engineers, 56th Annual Fall Technical Cnference, San Antonio, Texas, Oct. 5–7, 1981.

M. Soliman K. Petak, J. Christensen, R. Centanni, Paper No. 88–39–53, *Analysis of Sequential Formation Testing and Surge Tests Using New Techniques;;* Petroleum Society of CIM, 39th Annual Technical Meeting, Calgary, Jun. 12–16, 1988, pp. 53–1–29.

M. Soliman, *Analysis of Buildup Tests with Short Producing Time,* SPE Formation Evaluation, Aug. 1986, pp. 363–71.

P. Goode, R. Thambynayagam, SPE 20737, *Analytic Models for a Multiple Probe Formation Tester,* Society of Petroleum Engineers, 65th Annual Technical Conference, New Orleans, LA, Sep. 23–26, 1990.

R. Badry, E. Head, C. Morris, I. Traboulay, *New Wireline Formation Tester Techniques and Applications,* SPWLA 34th Annual Symposium, Calgary, Alberta, Jun. 13–16, 1993.

(List continued on next page.)

*Primary Examiner*—Michael Brock

[57] ABSTRACT

An improved formation testing method for measuring initial sandface pressure and formation permeability in tight zone formations exhibiting formation permeabilities on the order of 1.0–0.001 millidarcies based on pressure transients which occur shortly after the tester enters its pressure buildup cycle and substantially before reaching final buildup pressure. The method makes an estimate of formation permeability based on fluid decompression transients which occur in the formation tester flowlines which occur shortly after the tester begins its buildup cycle. The method further estimates initial sandface pressure based on the change in pressure over time shortly after beginning the buildup phase. The method of the present invention thereby permits accurate estimates of formation permeability and initial sandface pressure to be made relatively early in the buildup cycle, thus substantially reducing the time required to make the pressure and permeability measurements.

33 Claims, 12 Drawing Sheets

OTHER PUBLICATIONS

J. Pelissier–Combescure, D. Pollock, M. Wittmann, SPE7775, *Application of Repeat Formation Tester Pressure Measurement sin the Middle East,* Society of Petroleum Engineers, Middle East Oil Technical Conference, Manama Bahrain, Mar. 25–29, 1979.

T. Yildiz, R. Desbrandes, Z. Bassiouni, SPE 22753, *Flowline Storage Effect on Wireline Formation Testers,* Society of Petroleum Engineers, 66th Annual Technical Conference, Dallas, Texas, Oct. 6–9, 1991.

W. Brigham, J. Peden, K. Ng, N. O'Neill, SPE 9294, *The Analysis of Spherical Flow with Wellbore Storage,* Society of Petroleum Engineers, 55th Annual Fall Technical Conference, Dallas, Texas, Sep. 21–24, 1980.

J. Moran, E. Finkle, *Theoretical Analysis of Pressure Phenomena Associated with the Wireline Formation Tester,* Journal of Petroleum Technology, Aug., 1962, pp. 899–908.

G. Stewart, M. Wittmann, SPE 8362, *Interpretation of the Pressure Response of the Repeat Formation Tester,* Society of Petroleum Engineers, 54th Annual Fall Technical Conference, Las Vegas, Nevada, Sep. 23–26, 1979.

G. Stewart, M. Wittmann, T. van Golf–Racht, SPE 10181, *The Application of the Repeat Formation Tester to the Analysis of Naturally Fractured Reservoirs,* Society of Petroleum, Engineers, 56th Annual Fall Technical Conferene, San Antonio, Texas, Oct. 5–7, 1981.

T. Yildiz and J. Langlinais, SPE 18952. *A Reservoir Model for Wireline Formation Testing,* Society of Petroleum Engineers, Jount Rocky Mountain Regional/Low Permeability Reservoirs Symposium, Denver, Colorado, Mar. 6–8, 1989.

I. Papadopulos, H. Cooper, J., *Drawdown in a Well of Large Diameter,* Water Resources Research, vol. 3, First Quarter 1967, No. 1, pp. 242–244.

J. Joseph, L. Koederitz, *Unsteady–State Spherical Flow with Storage and Skin,* Society of Petroleum Engineers, Journal, Dec., 1985, pp. 804–822.

J. Joseph, L. Koederitz, SPE 12950, *Unsteady–State Spherical Flow With Storage and Skin,* Society of Petroleum Engineers, 59th Annual Technical Conference, Houston, Texas, Sep. 16–19, 1984.

P. Hegeman, D. Hallford, J. Joseph, *Well–Test Analysis With Changing Wellbore Storage,* SPE Formation Evaluation, Sep. 1993, pp. 201–207.

H. Ramey, Jr, R. Agarwal, *Annulus Unloading Rates as Influenced by Wellbore Storage and Skin Effect,;* Society of Petroleum Engineers 46th Annual Fall Meeting, New Orleans, Oct. 3–6, 1971, reprinted in Society of Petroleum Engineers Journal, vol. 12, No. 5, Oct, 1972, pp. 453–462.

J. Milburn, J. Howell *Formation Evaluation with the Wireline Tester–Merits and Shortcomings,* SPE Formation Evaluation Symposium, Houston, Texas, Nov. 21–22, 1960, reprinted in Journal of Petroleum Technology, Oct. 1961, pp. 987–94.

R. Agarwal, R. Al–Hussainy, H. Ramey, Jr., *An Investigation of Wellbore Storage and Skin Effect in Unsteady Liquid Flow: I. Analytical Treatment,* SPE 44th Annual Fall Meeting, Denver, Colorado, Sep. 1970, pp. 279–290.

A. F. Van Evergingen, W. Hurst, *The Application of the Laplace Transformation to Flow Problems in Reservoirs,* AIME Meeting, Dallas, Texas, Oct. 4–6, 1948, reprinted in Transactions of the American Institute of Mining and Metallurgical Engineers, vol. 186, Petroleum Development and Technology, 1949, Petroleum Branch, pp. 305–24–B.

C. Matthews and D. Russell, *Pressure Buildup and Flow Tests in Wells,* Chapter 2, *Mathematical Basis for Pressure Analysis Methods,* Society of Petroleum Engineers of AIME, 1967, pp. 4–17.

R. Collins, *Flow of Fluids Through Porous Materials,* Chap. 5, *Transient Laminar Flow of Homogeneous Fluids;* Research & Engineering Consultants, Inc., 1961, pp. 108–139.

M. Mulkat, *Physical Principles of Oil Production,* , Section 5.3, *Individual Well Problems,* 1949, McGraw–Hill Book Company, Inc., reprinted 1981 by International Human Resources Development Corporation, IHRDC, Publishers, Boston, Mass.; pp. 201–219.

I. Ershaghi, S. Rhee, H. Yang, SPE6018, *Analysis of Pressure Transient Data in Naturally Fractured Reservoirs With Spherical Flow,* Society of Petroleum Engineers, 51st Annual Fall Technical Conference, New Orleans, Oct. 3–6, 1976, 16 pages.

WIRELINE FORMATION TESTING FOR LOW PERMEABILITY FORMATIONS UTILIZING PRESSURE TRANSIENTS

BACKGROUND OF INVENTION

1. Field of Invention

This invention concerns a system for conducting wireline formation testing. More particularly, the invention concerns an improved method for determining formation permeability and initial sandface pressure in low permeability zones utilizing a wireline formation test tool.

2. Description of Related Art

The use of wireline well logging ("wireline logging") has long been an important technique utilized in the exploration and production of oil and gas. Generally, a sensitive measuring instrument is lowered on an armored cable into a wellbore, the cable having at least one conductor therein, and measurements are made at different depths in the well. The measuring instrument may include tools or sondes intended to perform electrical investigation, nuclear investigation, acoustic investigation or to test formation characteristics. Electrical logs are typically used to locate hydrocarbon reserves, whereas nuclear logs are employed to determine the volume of hydrocarbons in the reserves, typically by determining the porosity of the materials in potential production depths or zones identified by the electrical logs. Formation pressure testing logs ("formation testing logs") are utilized to determine the mobility or ease with which the reserves may be produced by determining the formation production zone pressure and permeability.

A wellbore is typically filled with a drilling fluid such as water or a water-based or oil-based drilling fluid. The density of the drilling fluid is usually increased by adding certain types of solids, such as various salts and other additives, that are suspended in solution. These salts and other additives are often referred to as "drilling muds." The solids increase the hydrostatic pressure of the wellbore fluids to help maintain the well and keep fluids of surrounding formations from flowing into the well. Uncontrolled flow of fluids into a well can sometimes result in a well "blowout."

The solids within the drilling fluid create a "mudcake" as they flow into a formation by depositing solids on the inner wall of the wellbore. The wall of the wellbore, along with the deposited solids, tends to act like a filter. The mudcake also helps prevent excessive loss of drilling fluid into the formation. The static pressure in the well bore and the surrounding formation is typically referred to as "hydrostatic pressure." Relative to the hydrostatic pressure in the wellbore, the hydrostatic pressure in the mudcake decreases rapidly with increasing radial distance. Pressure in the formation beyond the mudcake gradually tapers off with increasing radial distance outward from the wellbore.

As shown in FIG. 1A, pressure is typically distributed in a wellbore through a formation as shown by the pressure profile 100. Pressure is highest at the wellbore's inner wall, i.e., the inside surface of the mudcake at point and is equal to the hydrostatic pressure Pm 102 inside the wellbore. The mudcake acts like a filter, restricting the flow of fluids from the high pressure of the wellbore into the relatively lower pressure of the formation. Thus, there is a rapid pressure drop through the mudcake. The pressure at point 104 at the interface between the mudcake and the formation (the "sandface pressure") is substantially lower than the pressure at point 102 at the inside surface of the mudcake. Conventional mudcakes are typically between about 0.25 and 0.5 inch thick, and polymeric mudcakes are often about 0.1 inch thick. Beyond the mudcake, the formation exhibits a gradual pressure decrease illustrated by the slope 106.

Ideally, pressure and permeability of the formation need to be known in the production zone prior to the setting of the casing. Several known methods may be used to determine this. One method is the use of rotary sidewall cores. However, analysis of rotary sidewall cores require up to 24 hours and must be corrected to estimate in situ permeabilities, i.e. as they actually exist in the formation. The sidewall core analysis is generally performed on dry samples which may exhibit different permeabilities when compared with water saturated permeabilities which may exist in situ. This is especially true in zones exhibiting low formation permeability on the order of 1.0–0.001 millidarcies. The zones of low formation permeability are often referred to as "tight zones." Dry tight zone permeabilities dry based on sidewall core analysis can vary almost an order of magnitude when compared to water saturated permeabilities encountered in situ.

Formation testing tools may also be used to predict the pressure of a hydrocarbon bearing formation around a well, and to thereby better understand the hydrocarbon's producibility. The structure of a formation tester and its operation are explained with reference to FIG. 2. The pressures seen or detected by the formation tester during operation are set forth in FIG. 3. In a typical formation testing operation, a formation tester 200 is lowered into a wellbore 202 with a wireline cable 201, as illustrated in FIG. 2A. Inside the wellbore 202, the formation tester 200 resides within drilling fluid 204. The drilling fluid 204 typically forms a layer of mudcake 206 on the walls of the wellbore 202, in accordance with known techniques. In many cases, equipment (not shown) for conducting other types of logs, such as gamma ray logs, may be attached to the same wireline cable as the formation tester, below and/or beneath the formation tester 200. The operation of the formations tester 200 may be readily understood with reference to the structure of the tester 200 set forth in FIG. 2 and FIG. 3 graph of the pressures detected by pressure sensor 216 during the operation of the formation tester 200.

After the formation tester 200 is lowered to the desired depth of the wellbore 202, along with any other equipment connected to the wireline cable 201, pressure in a flow line 219 is equalized to the hydrostatic pressure of the wellbore by opening an equalization valve 214. Since the equalization valve 214 is located at a high point of the tester 200, opening the valve 214 permits bubbles and lighter fluids to escape out into the wellbore 202 through the flow lines 215. Then, a pressure sensor 216 may be used to measure the hydrostatic pressure (FIG. 3, 302) of the drilling fluid. In the illustrated embodiment, the equalization valve 214 is a two-way valve that simply enables or disables fluid flow through the flow lines 215.

After the equalization valve 214 is again closed, the tester 200 is secured in place by extending hydraulically actuated feet 208 and an opposing isolation pad 210 against opposite sides of the wellbore walls. The pad 210 surrounds a hollow probe 212 (sometimes called a "snorkel"), which is connected to plumbing internal to the tester 200, as described below. Initially, as the pad 210 is extended against the wellbore wall, the pressure inside the probe 212 slightly increases. This pressure increase (FIG. 3, 304) followed by a decrease is illustrated in FIG. 3 by the set pressure (FIG. 3, 306) prior to the start of the pretest.

Fluid from the formation 222 is drawn into the tester 200 by mechanically retracting a pretest piston 218. The retracting of the protest piston 218 creates a pressure drop at the probe 212, thereby drawing formation fluid into the probe 212, the flowline 219, and a pretest chamber 220. The isolation pad 210 helps prevent borehole fluids 204 from flowing outward through the mudcake 206 and circling back into the probe 212 and the chamber 220. Thus, the isolation pad 210 "isolates" the probe 212 from the borehole fluids 204, helping to ensure that the measurements of the probe 212 are representative of the pressure in the formation 222. When the piston 218 stops retracting, formation fluid continues to enter the probe 212 until the pressure differential between the chamber 220 and the formation 222 is minimized. The drawdown pressure ($p_{dd}$, 308, FIG. 3) corresponds to the pressure detected by the sensor 216 while the formation fluid is being withdrawn from the formation. The buildup pressure increase ($p_{bu}$, 310, FIG. 3) corresponds to the pressure detected while formation fluid pressure is building up again after the drawdown period, i.e., after the pretest piston 218 stops moving. This final buildup pressure is frequently referred to as the "sandface pressure." It is usually assumed that the sandface pressure is close to the formation pressure. The drawdown 308 and buildup 310 pressures are used in determining formation permeability. The rate of the pressure buildup is slowed, primarily due to the cushion effect of the flowline 219 volume, which is generally greater than the volume of pretest chamber 220. This flowline cushion effect renders much of the $p_{bu}$ plot versus time unusable for known pressure/flow analysis techniques such as the radial or "Horner" analysis or spherical models. This flowline distortion in the buildup pressure does not dissipate until the difference in the recorded pressure and the final buildup pressure is small. If further fluid samples are desired in addition to the fluid in the chamber 220, control valves 224 may be individually opened and closed at selected times to capture fluid samples in supplemental chambers 226. When the formation tester 200 is disengaged from the wellbore wall, the detected formation pressure 312 increases rapidly due to the removal of pressure applied by the pad 210.

After the desired measurements are made, the formation tester 200 may be raised or lowered to a different depth to take another series of tests. At each depth, the tests usually require a short period of time, such as five minutes. However, tight zone testing requires a considerably greater time for the buildup pressure to occur, often as much as one hour, thereby magnifying the effects of flowline distortion. This flowline distortion effect is one of the major factors affecting pressure measurements in tight zones. The fluid samples are examined and the measured fluid pressures are analyzed to determine the fluid mobility, as influenced by factors such as the porosity and permeability of the formation fluids.

Another effect which can distort wireline formation pressures is the effect of wellbore fluids entering the formation. Normally, the mudcake prevents excessive loss of the drilling fluid into the formation. When the mudcake formation approaches a steady-state condition, a pressure gradient is established in the formation as illustrated in FIG. 1A. The pressure in the well bore (hydrostatic pressure) drops rapidly across the mudcake then gradually reduces to formation pressure. This pressure gradient can be predicted using Darcy's law.

Pressure readings in formation testers are adversely affected in "supercharged regions," FIG. 1B. In a supercharged region, the mudcake fails to adequately hold the drilling fluid in the wellbore, and the drilling fluid penetrates the formation creating an "invaded zone." In the invaded zone, the fluid pressure is increased. The effect of supercharging on the operation of a formation pressure tester is illustrated by the curve 305 in FIG. 3. With supercharging, the pressures detected by the formation tester is initially higher (301) than without supercharging (302). During drawdown, as the pretest piston 218 retracts, the pressure rapidly decreases (302), but normalizes at a level greater than the non-supercharged formation pressure (308). When the pretest piston 218 stops, fluid pressure rapidly builds up again (309), and pressure increases and eventually normalizes to a value corresponding to the supercharged formation pressure. When the formation pressure testing tool is disengaged from the wellbore, the detected formation pressure rises again (311).

Pressure measurements may also be adversely affected if the mudcake permeability is nearly the same as the permeability of the zone. The sandface pressure measured by the formation pressure will approach hydrostatic pressure. Under these conditions, the mud filtrate is not inhibited from invading the formation. This is particularly true in low permeability zones where the sealing influence of the mudcake is small. In low permeability formation, flow into the probe can be very slow during a buildup test. If the mudcake has little sealing quality, mud filtrate ca seep through the mudcake into the formation at a rate comparable to that of the rate being drawn into the tester probe 212. FIG. 4 shows how mud filtrate flows into the formation and is diverted to production into the probe 212. This communication with the wellbore can produce an additional supercharge effect on the pressure buildup, making permeability and initial sand face pressure estimates difficult.

There are two mechanisms that cause the flow of formation fluid into the probe 212 in the buildup state. First, the compressibility of the fluid in the formation 222 creates a pressure differential between the probe 212 and the formation pressure. The second mechanism is the compressibility of the fluid in the flow line 219 in contact with the probe 212. This fluid is decompressed, creating an additional pressure differential between the probe 212 and the formation 222. However, many conventional analysis techniques ignore these mechanisms, assuming that the wellbore pressure is isolated from the formation near the probe and that little or no fluid flows across the mudcake. As discussed above, fluid flow across the wellbore boundary may be significant due to the permeability of the mudcake, and such flow may be especially acute in supercharged regions. Therefore, known methods for measuring formation pressure are not as accurate as some people would like, especially when applied in supercharged regions.

Several known methods are utilized to compensate for the distorting effect of supercharging by measuring formation pressure at various depths and by making estimations based on deviations from a linear pressure relationship. Although this approach might be adequate for some applications, it is limited because it fails to actually quantify the effect of supercharging, and therefore lacks the level of accuracy some people require. These problems associated with supercharging effects, flowline and mudcake invasion severely limit the effectiveness of formation testing in tight zones.

SUMMARY OF INVENTION

The present invention is directed to a method for determining formation pressures and permeabilities in tight zones having a low formation permeability where the effects of flowline storage and supercharging are the greatest. Moreover, the present invention is capable of developing real time interpretations of pressure and permeability information based on relatively short transient pressures. A determination may then readily be made whether to stop or continue the formation test. As noted above, a formation test cycle for a tight zone often exceeds an hour per test cycle. It will be appreciated that the present invention provides rapid answers regarding formation permeability and pressures.

The present invention may utilize conventional formation testers to provide the information necessary to determination of tight zone permeability and pressures. Specifically, the present invention is concerned with four characteristics: the in situ compressibility of the formation, a real time permeability determination, a tight zone permeability and a tight zone initial determination.

The in situ compressibility is a calculated compressibility of the fluid in the flow lines 219 based on the rate of drawdown (308 FIG. 3). The compressibility can be estimated based on the volume of fluid that is in communication with the pretest piston (218 FIG. 2) and the rate of change in the pressure during drawdown (308 FIG. 3). This in situ compressibility is utilized to calculate the real time and tight zone permeabilities.

The real time permeability is used to estimate the permeability during the buildup and to determined when flowline storage effects and supercharging are influencing pressure measurement. Real time permeability is also utilized (a) as a control parameter to determine when a test may be terminated and (b) as an estimate of the sandface pressure. The ability to determine whether to continue a test early during the test cycle is particularly important when test cycle times can exceed an hour. The real time permeability is determined as a function of the initial sandface pressure and rock and fluid properties. Alternatively, the real time permeability may be determined based on the rate of pressure drop over a period of time.

The tight zone permeability is used to make an early estimate of the permeability that is unaffected by flowline storage and is relatively unaffected by supercharging effects. This estimate is based on the assumption that the majority of fluid extracted from the formation occurs during the early buildup time (after the pretest piston has stopped moving) and is a result of the fluid decompression in the flowline. Typical pressure buildup curves in tight zones show a rapid pressure drop during the drawdown stage and does not reach a steady-state condition. The pressure then builds slowly at a steady rate for a long period of time. Because the rate of change is slow, the instantaneous rate of flow at the sand face can be determined from the rate of flowline decompression.

The last parameter is the tight zone initial sandface pressure. Typical initial sandface pressure measurement are adversely affected by flowline storage and supercharging, these effects being magnified in tight zones. The estimated tight zone initial sandface pressure can be determined early on during the test cycle. The tight zone initial sandface pressure is based on the measured pressure based on the flowline and pretest chamber volume as a function of time, permeability and fluid compressibility. Alternatively, the initial sandface pressure may be estimated by plotting the change in pressure over time against its derivative during the early buildup period.

The present invention greatly reduces the time required to determine the permeability and formation pressure in a tight zone. This reduction in time can lead to significant cost reductions due to a decrease in rig down time during logging operations.

BRIEF DESCRIPTION OF DRAWINGS

The nature, objects, and advantages of the invention will become more apparent to those skilled in the art after considering the following detailed description in connection with the accompanying drawings, in which like reference numerals designate like parts throughout, wherein:

FIG. 5(*b*) is a plot of in situ compressibility utilizing the present invention made during the drawdown time period;

FIG. 5(*c*) is a plot of the buildup pressure based on the real time permeability technique;

FIG. 5(*d*) is a plot of the real time permeability based on late buildup time;

FIG. 5(*e*) is a plot of initial sandface pressure for low permeability zones using early time data;

FIG. 5(*f*) is a plot used to estimate tight zone permeability from early buildup time pressure data;

FIG. 6(*b*) is a plot of in situ compressibility utilizing the present invention made during the drawdown time period in tight zone simulations;

FIG. 6(*c*) is a plot of the initial sandface pressure in tight zone simulations;

FIG. 6(*d*) is a plot of the real time permeability based on late buildup time in tight zone simulations;

FIG. 6(*e*) is a plot of tight zone initial sandface pressure for low permeability zones using early time data;

FIG. 6(*f*) is a plot used to estimate tight zone permeability from early buildup time pressure data.

DETAILED DESCRIPTION OF A PREFERRED EMBODIMENT

An additional description of the preferred embodiment may be gained with reference to Appendix A attached to this application. For ease of reference, the following convention when referencing the Appendix: A2, Eq. 2, refers to Appendix page 2 and Equation 2. The present invention, in the following illustrative embodiment may be carried out using known wireline formation testers. For example, the invention may advantageously employ such tools as the Sequential Formation Tester ("SFT") or the Hybrid Multi-Set Tester ("HMST") tools produced by Halliburton. Operation of the formation tester in both instances is essentially as described in the background of the present invention.

The method of the preferred embodiment allows a user to determine the formation pressure and permeability in tight zones using conventional formation testing tools in relatively little time. It will be appreciated that the time normally required for tight zone tests is significant and can lead to substantial rig down time and costs. The method of the preferred embodiment addresses this problem by basing its interpretation on pressure transients during the test cycle which occur over a relatively short period of time in comparison to the entire test cycle.

Figure 3:
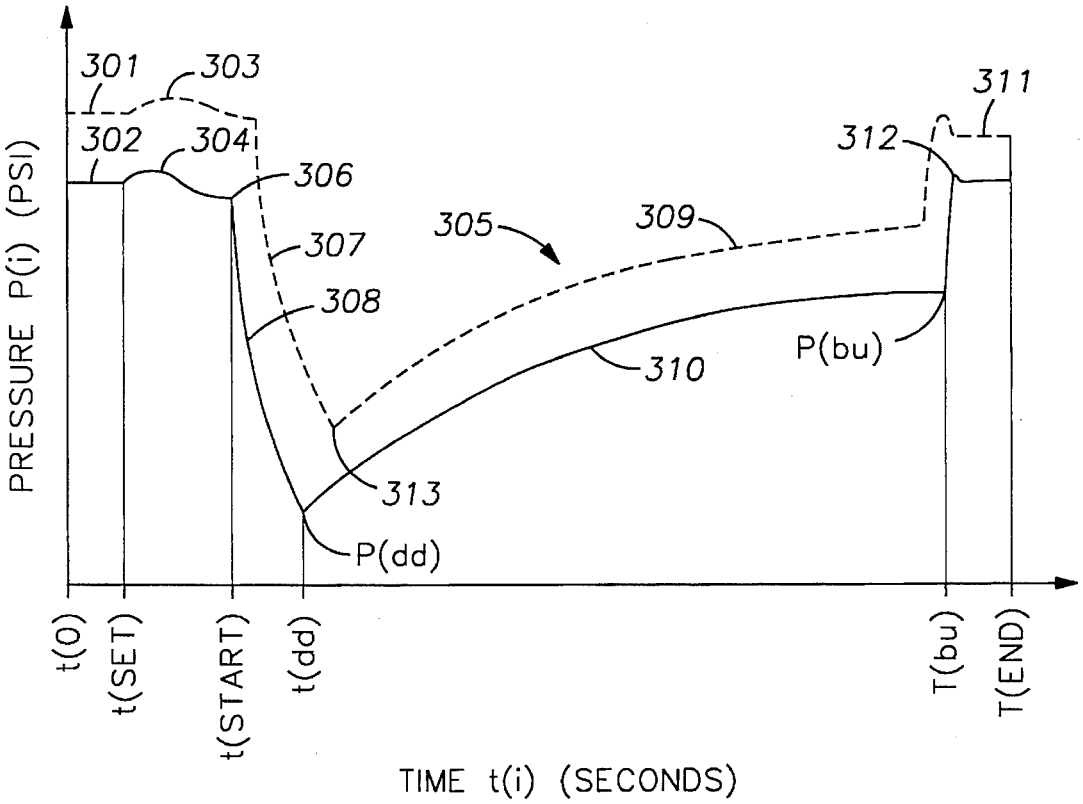
FIG. 3 is a graph contrasting pressures detected by a formation tester in a supercharged region and a non-supercharged region over a period of time.
Figure 4:
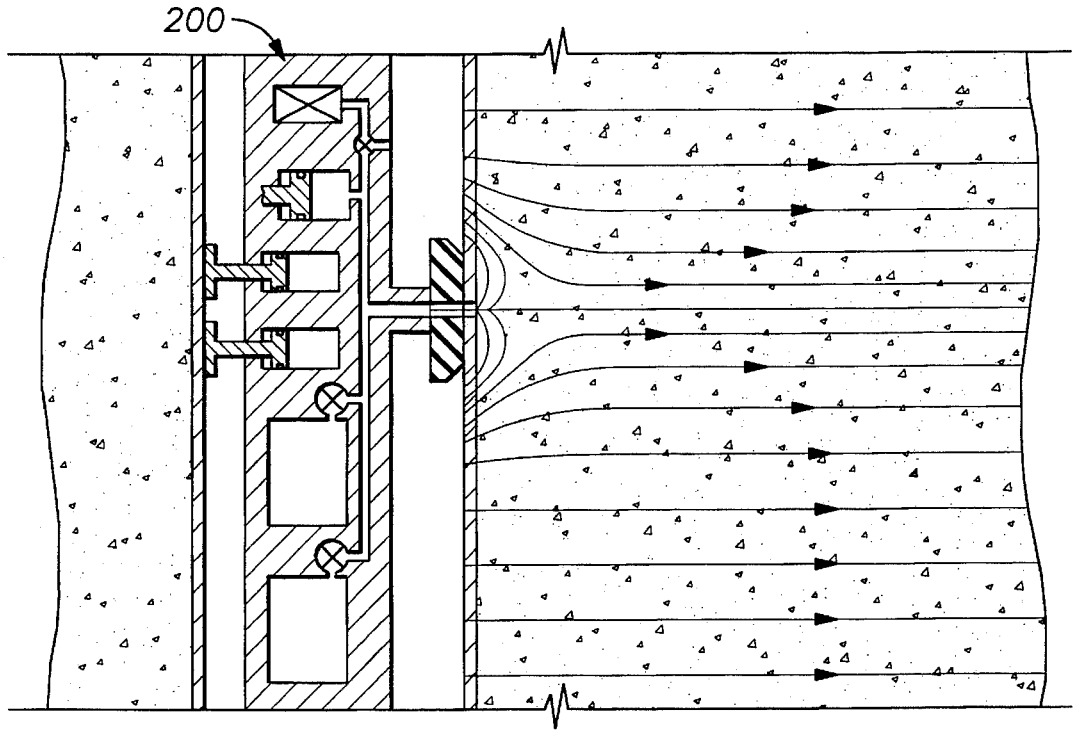
FIG. 4 is a diagram illustrating mudcake interference in pressure measurements in a supercharged region.
Figure 5B:
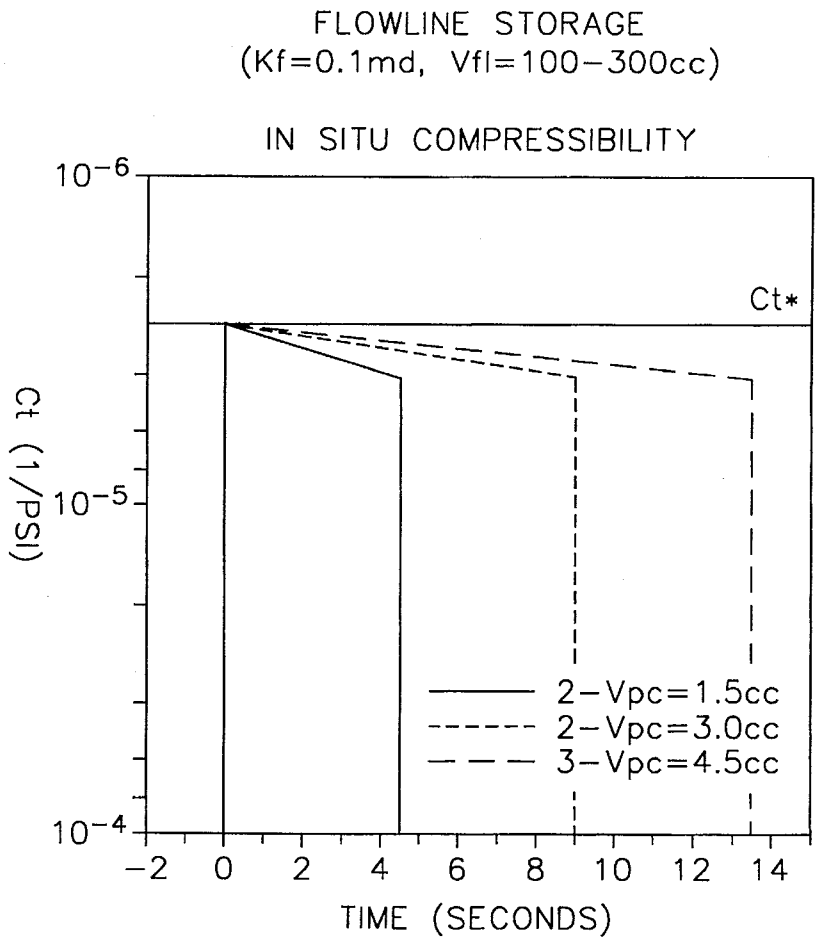
FIG. 5(*a*) is a plot of sensor detected pressure versus time during the drawdown and buildup cycles of a formation tester operation.
Figure 5A:
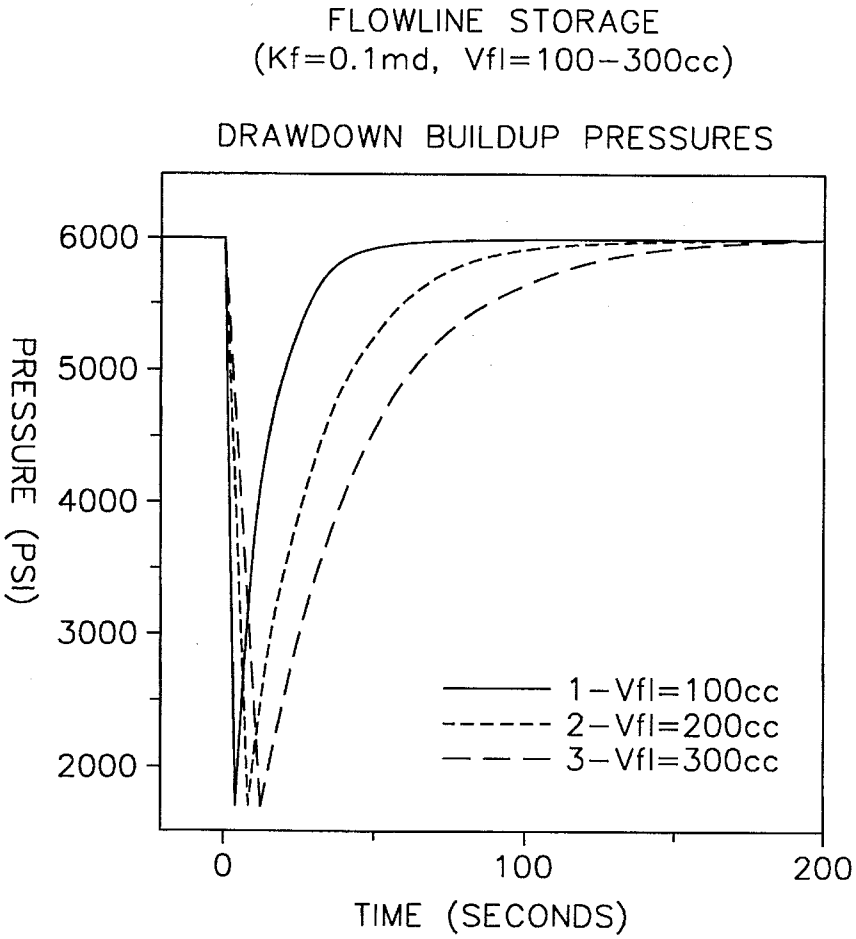
Figure 5D:
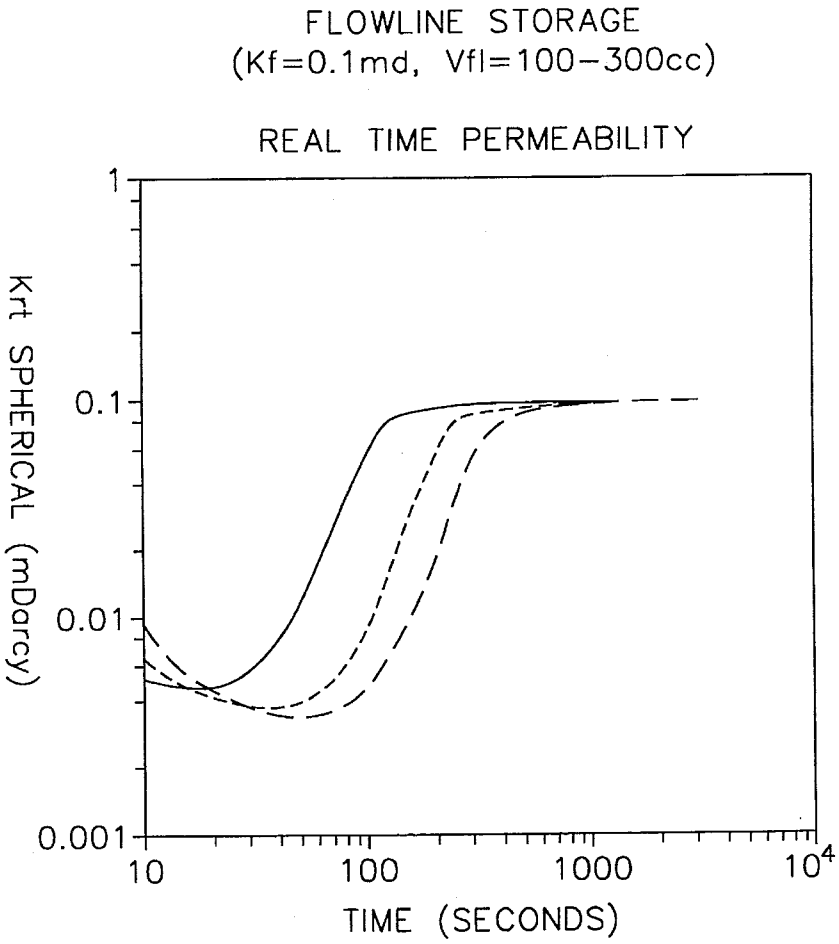
Figure 5C:
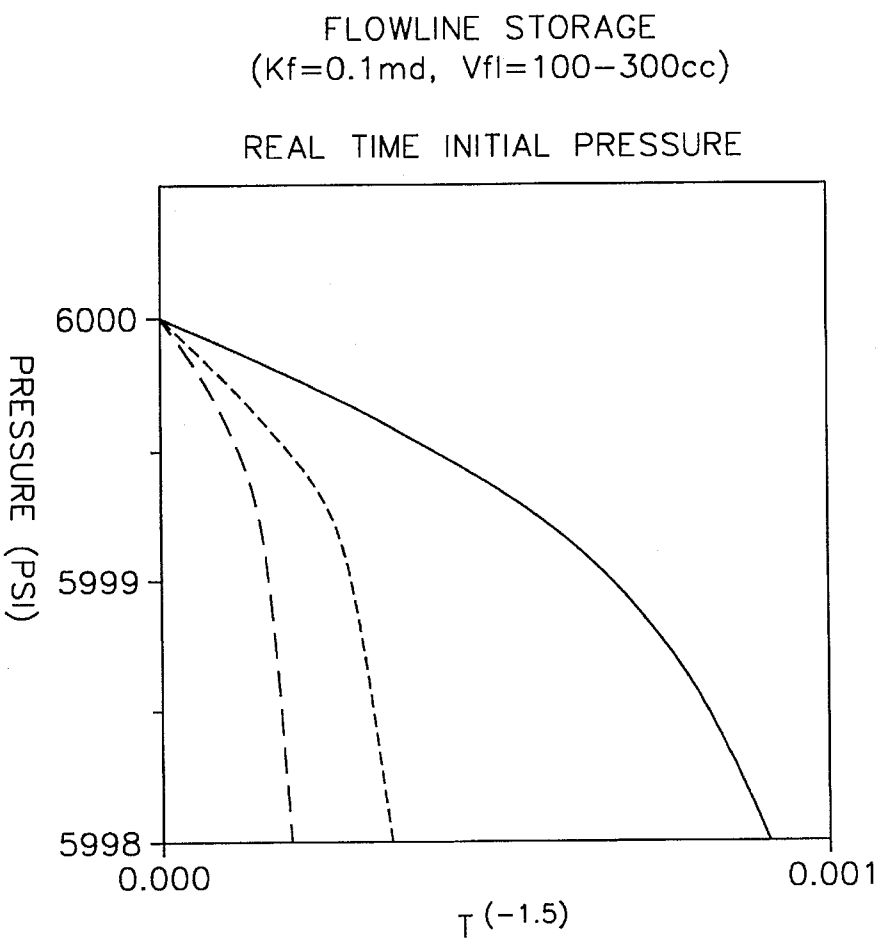
Figure 5F:
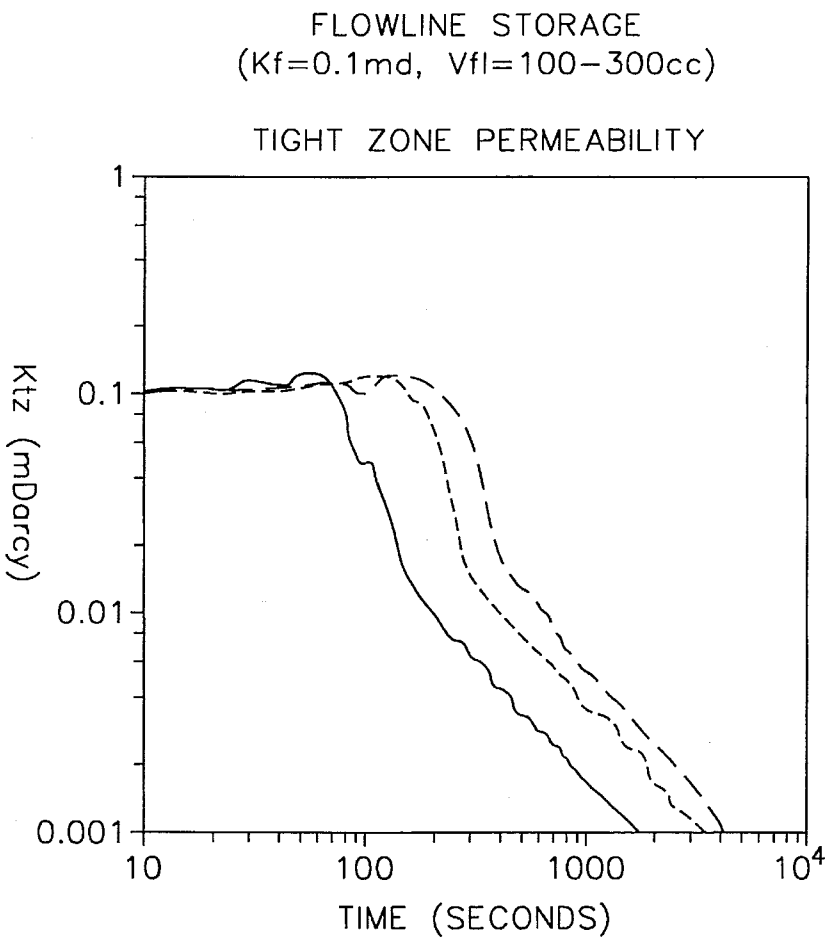
Figure 5E:
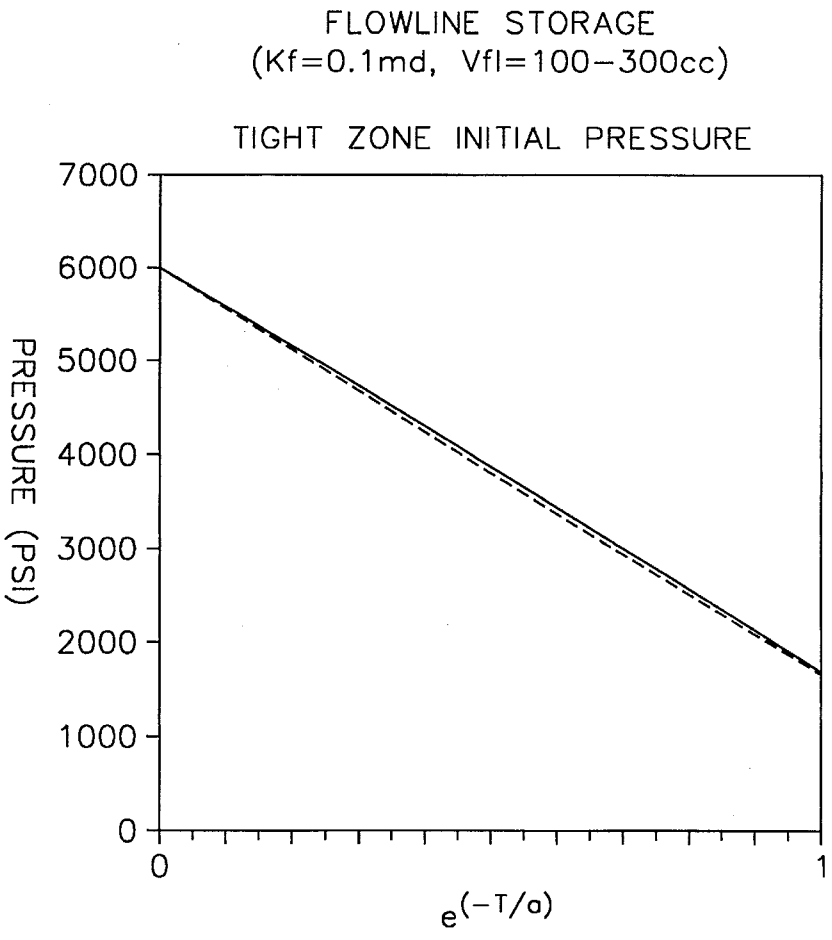
Figure 6B:
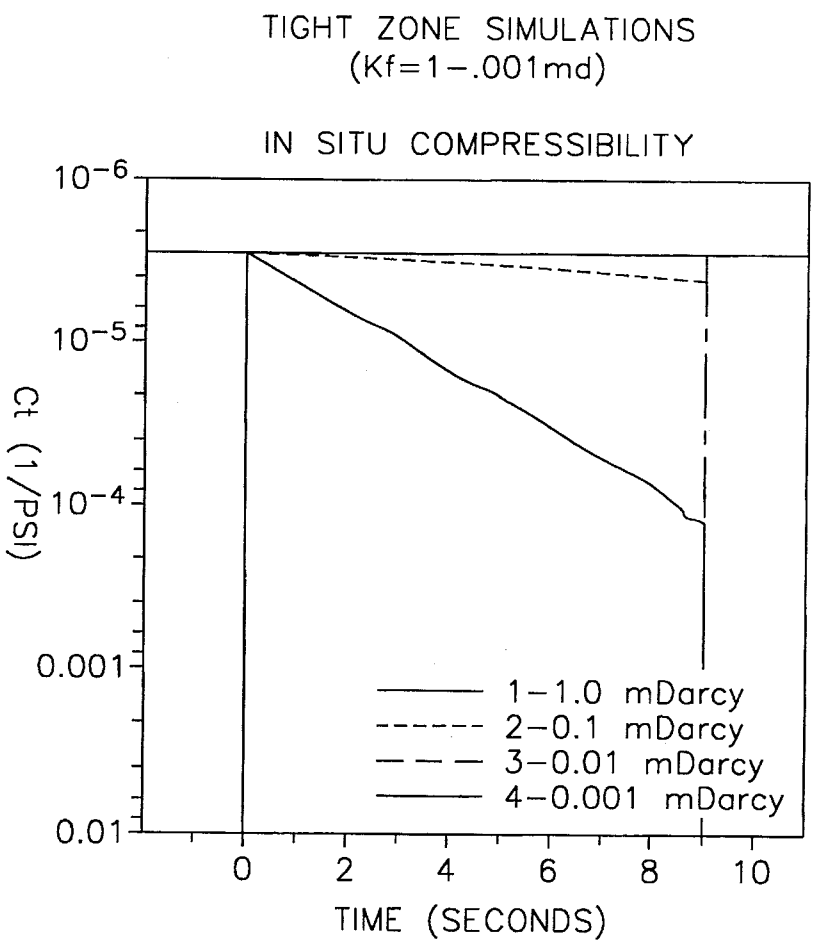
FIG. 6(*a*) is a plot of sensor detected pressure versus time during the drawdown and buildup cycles of a formation tester operation in tight zone simulations.
Figure 6A:
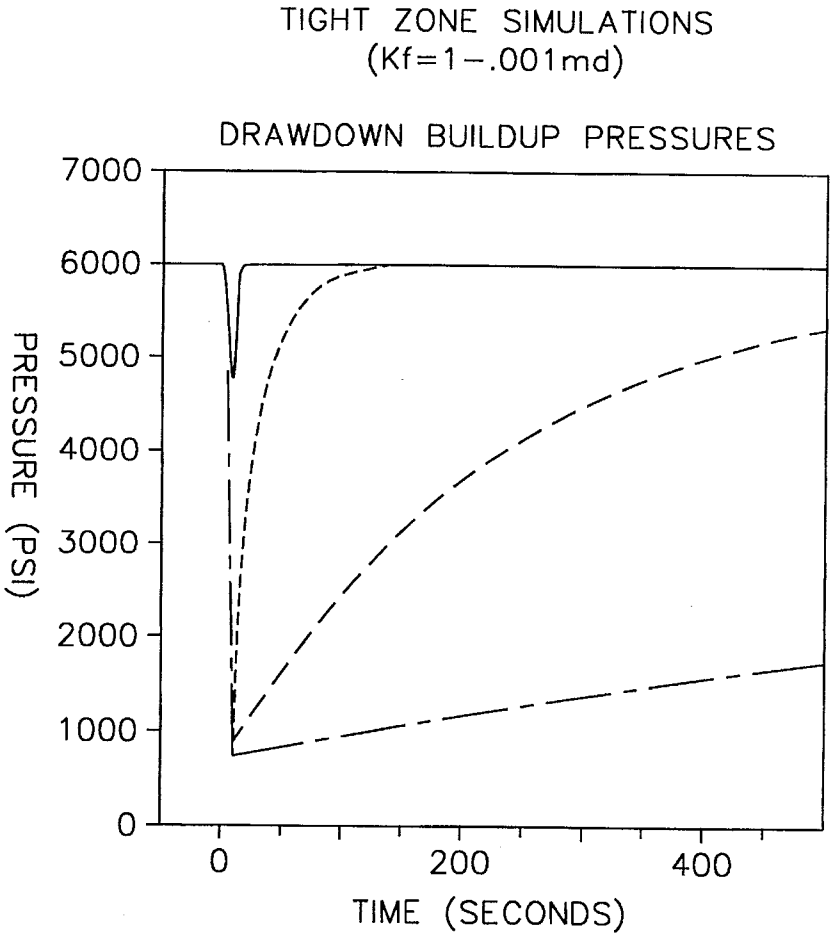
Figure 6D:
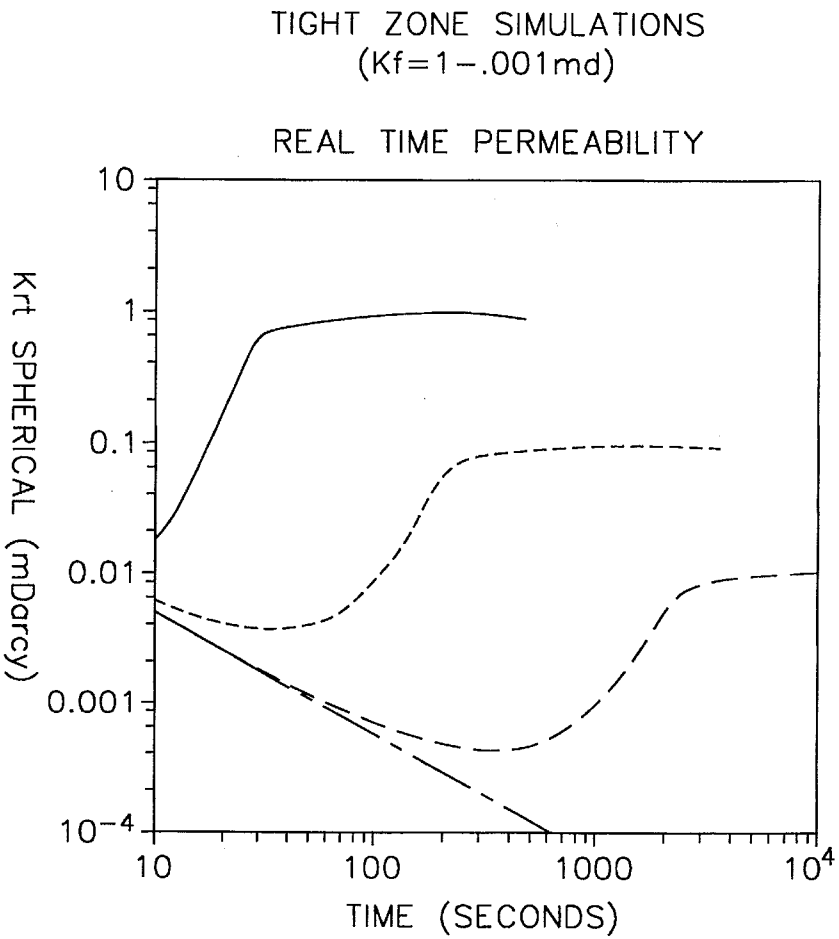
Figure 6C:
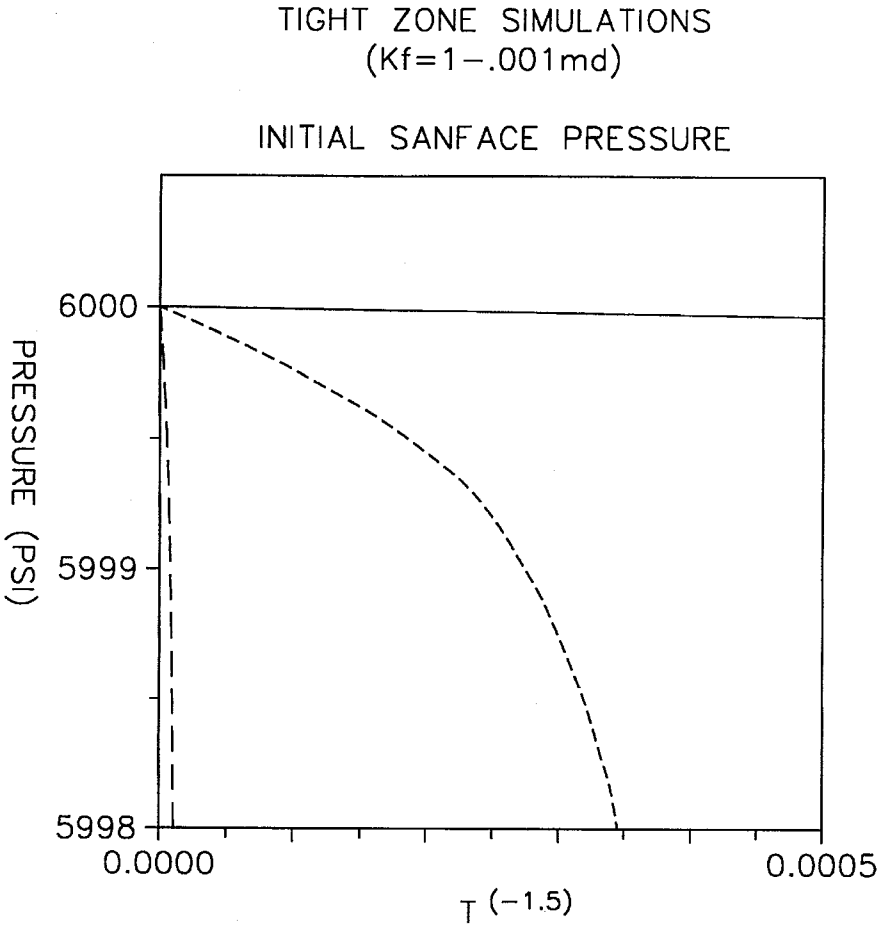
Figure 6F:
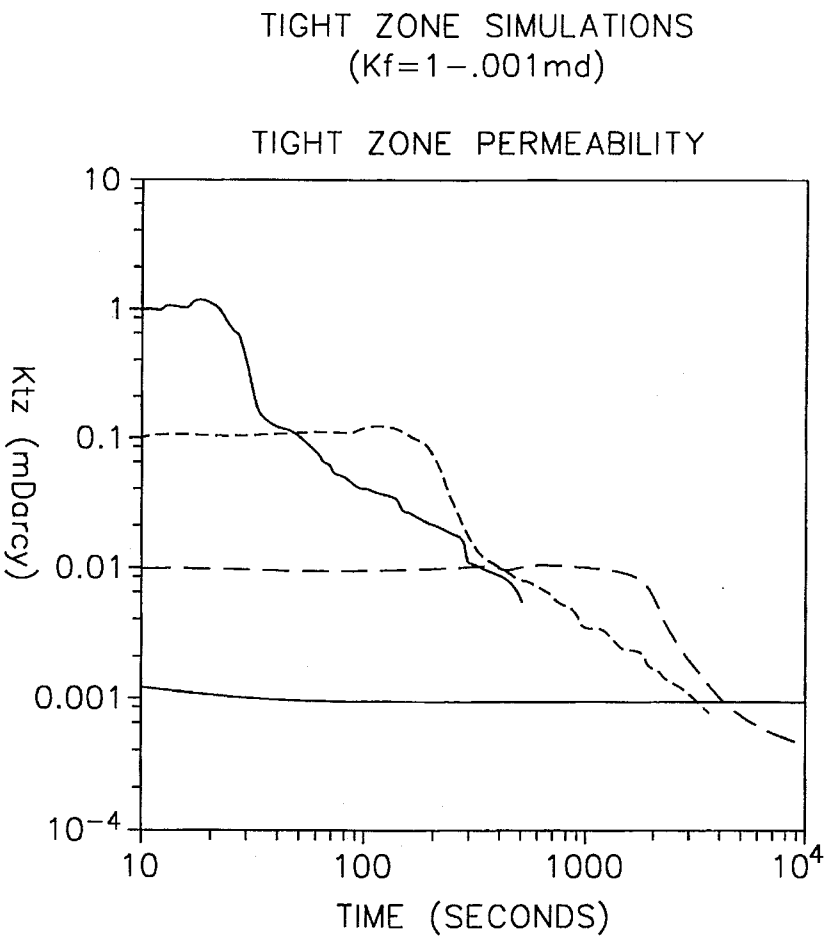
Figure 6E:
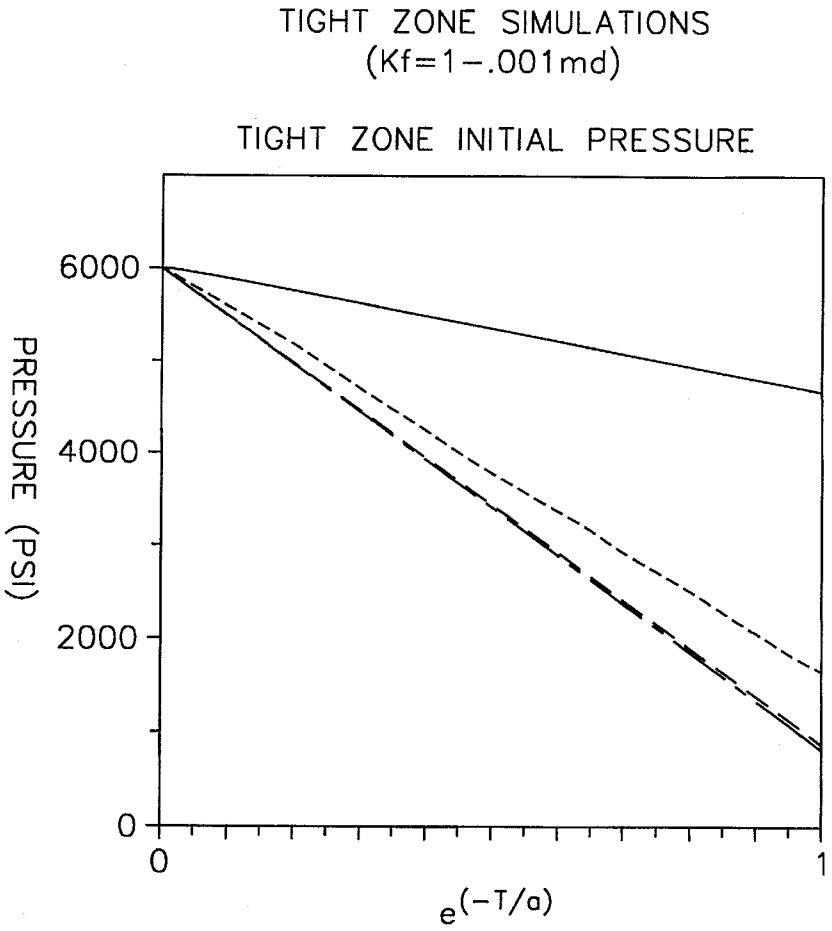
Figure 7B:
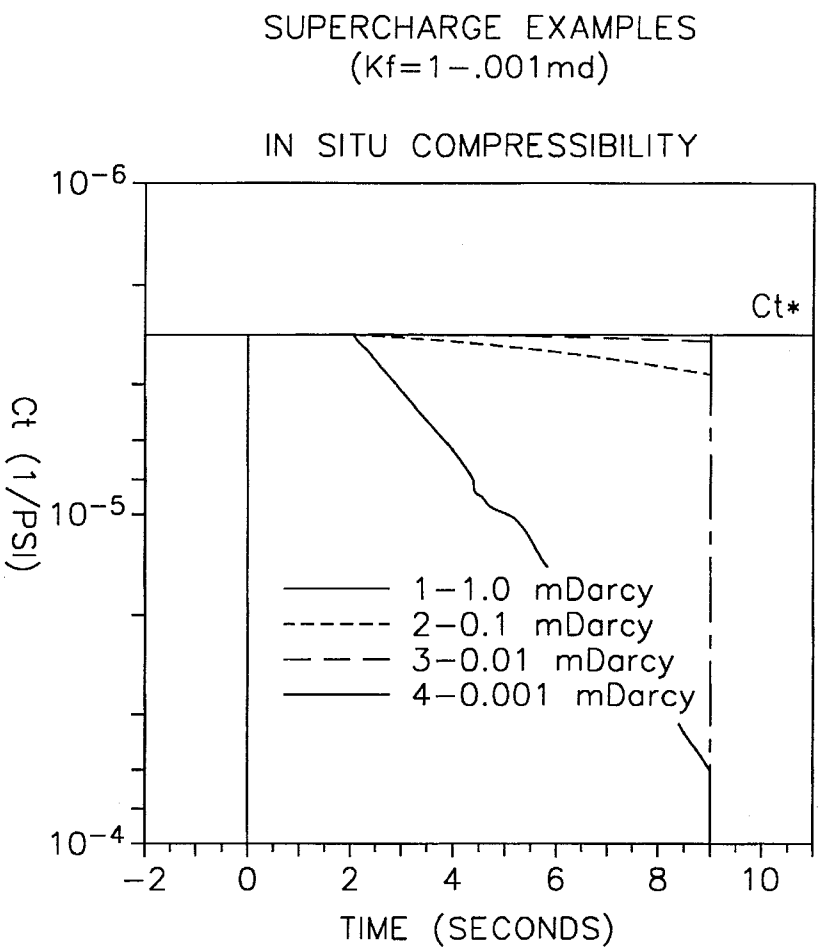
FIG. 7 is a plot of the calculation of tight zone initial pressure using a derivative of pressure over time.
Figure 7A:
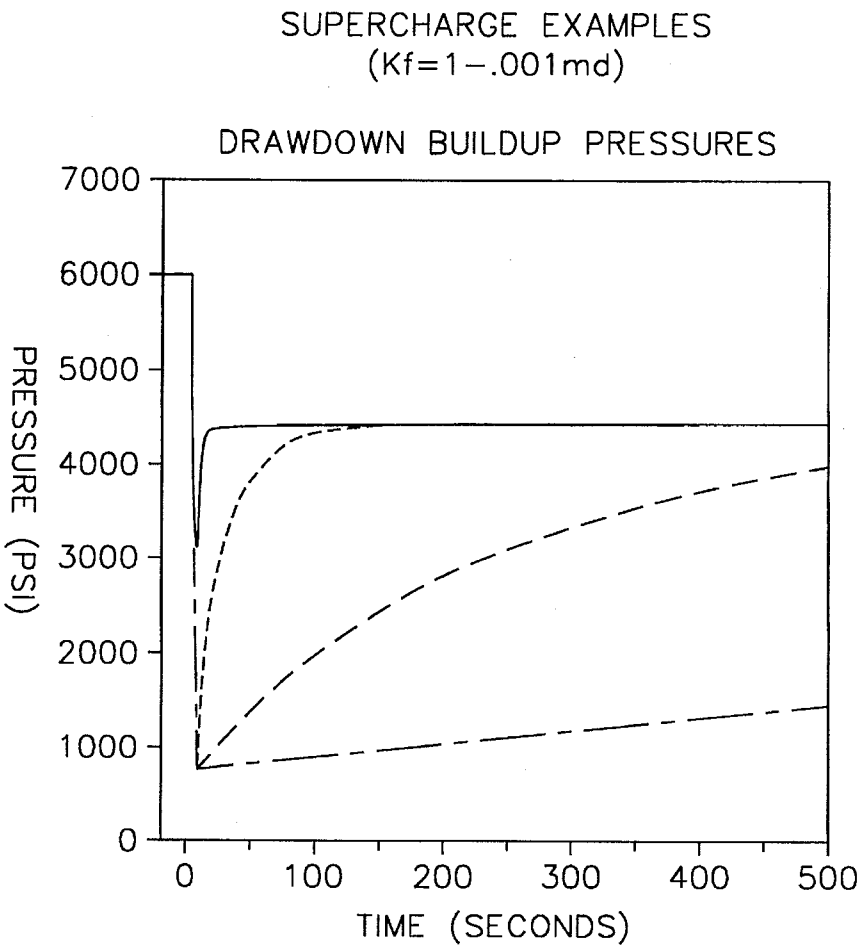
Figure 7D:
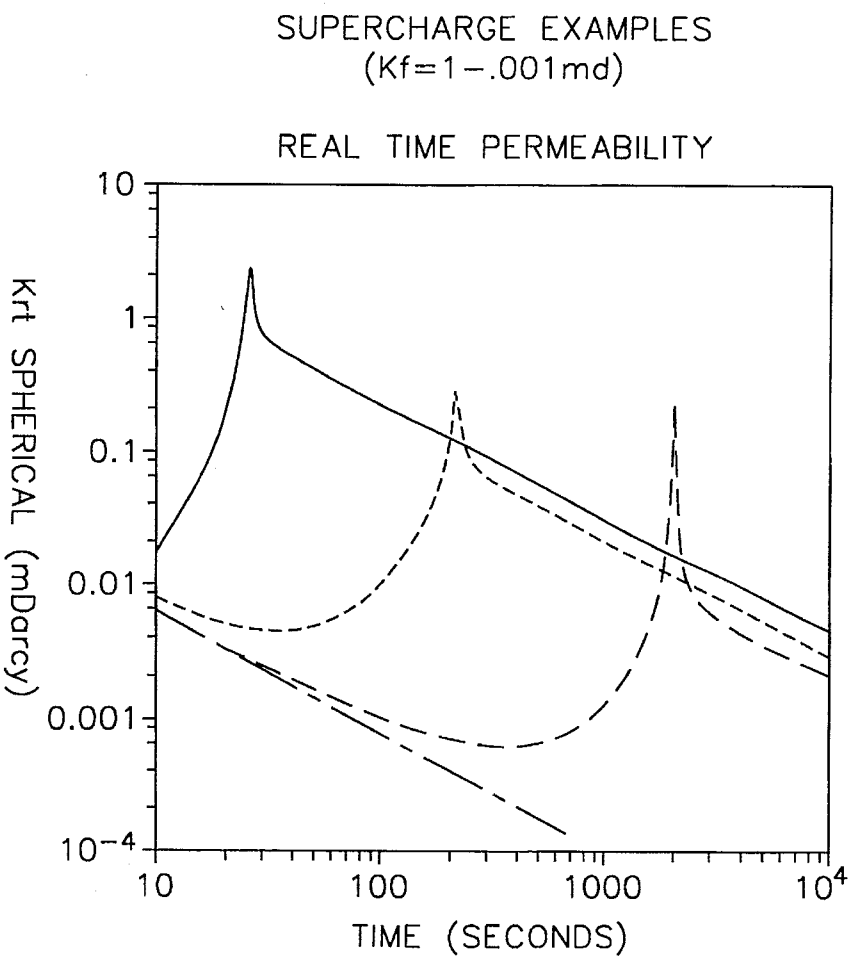
Figure 7C:
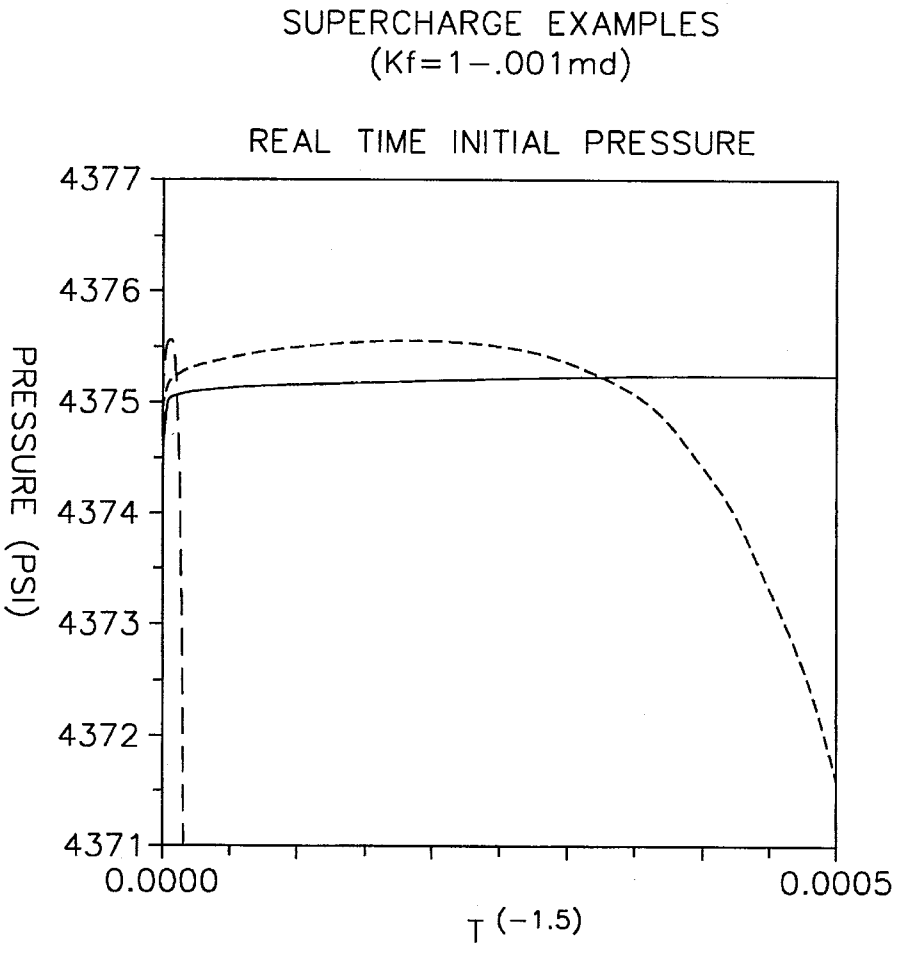
Figure 7F:
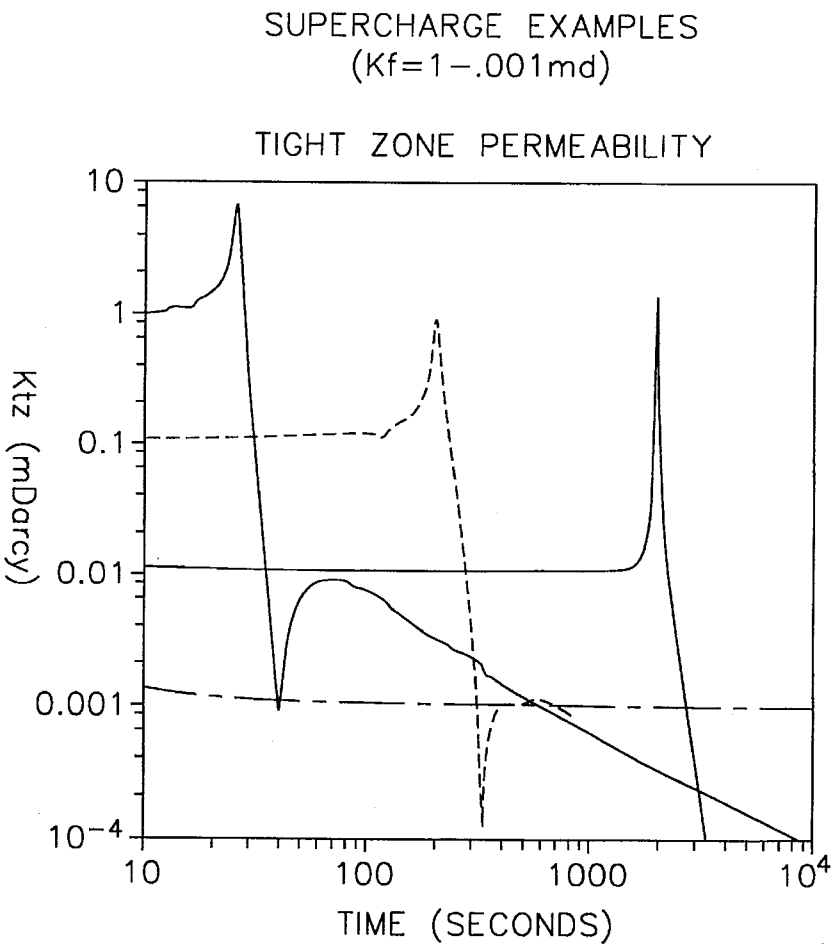
Figure 7E:
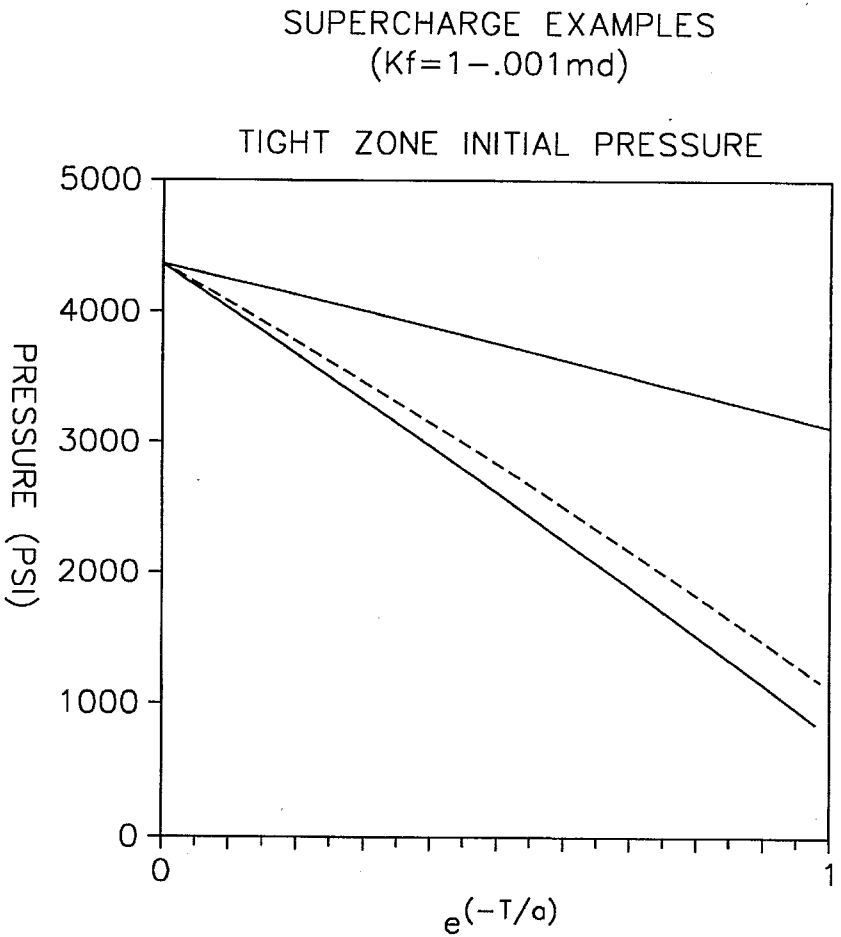

In the preferred embodiment, all of the information necessary to make the required permeability and pressure estimates are generated early within the pressure buildup cycle (310, FIG. 3). The pressure information is utilized to generate four characteristics of the formation.

1. In Situ Compressibility $c_t$*

Figure 1A:
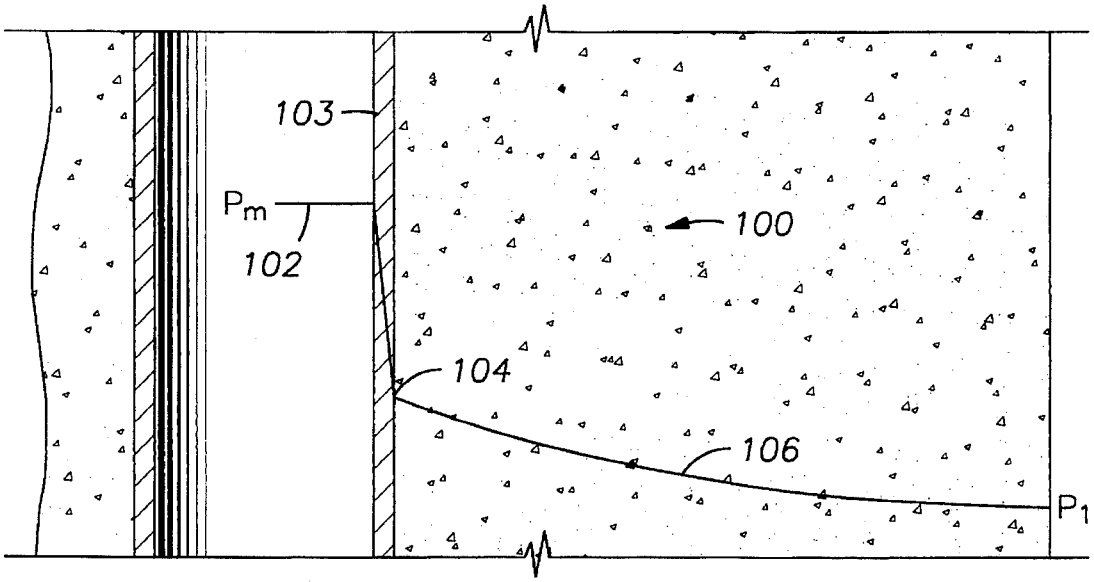
FIGS. 1A and 1B illustrate the relationship between pressure and radial distance from the wellbore in a normal and a supercharged case, respectively.
Figure 1B:
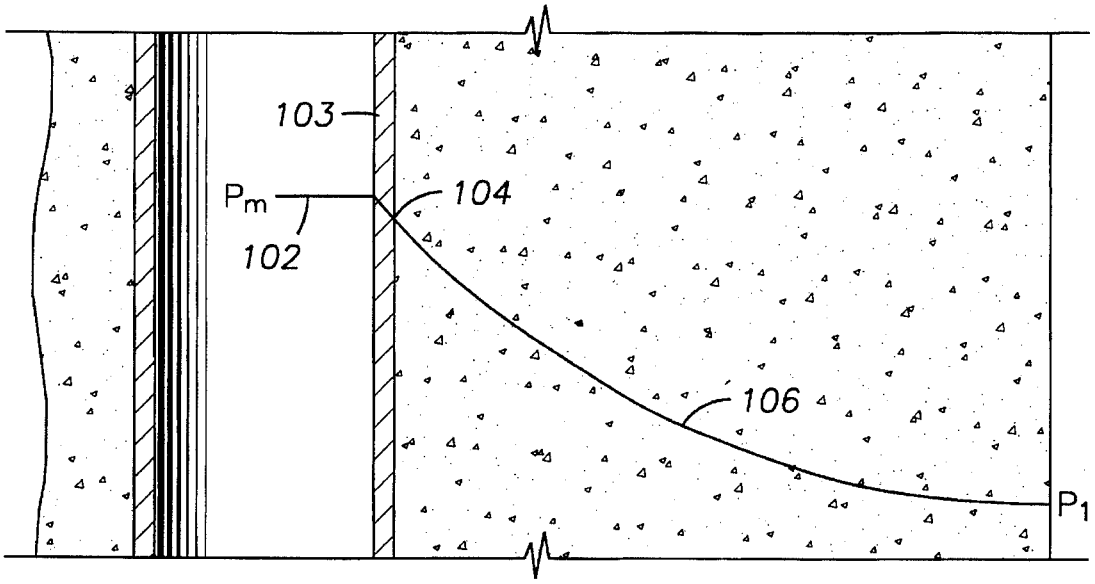
Figure 2A:
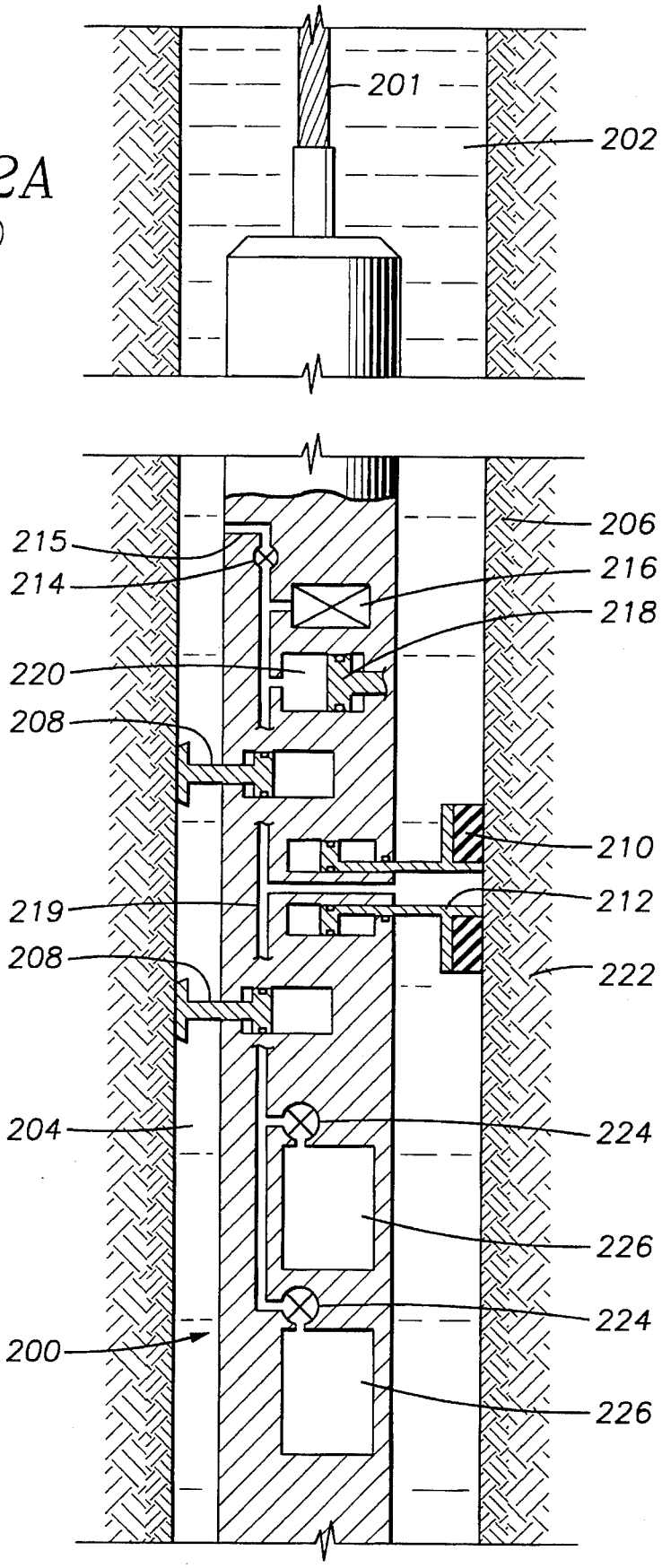
FIG. 2A (PRIOR ART)
FIG. 2 is a diagram of a known wireline formation tester.

The in situ compressibility is a calculated compressibility of the fluid in the flowlines based on the rate of drawdown. During the initial drawdown time period, the fluid in the flowline 219 (FIG. 2) is decompressed by the pretest piston 218 movement. When the drawdown pressure drops below the sandface pressure, the mudcake at the probe may be pulled away by the start of fluid being extracted from the formation. Since the volume of the fluid in the flowline 219 is known and the rate of decompression is known, the compressibility of flowline 219 fluid can be determined by comparing the pressure derivative to the rate of volume change created by the pretest chamber. The in situ fluid compressibility can be determined by locating the minimum of the pressure derivative from the time period $t_{start}$ to $t_{dd}$ (FIG. 3). The specific equations which may be utilized to derive $c_t$* are set forth on A12, Eqs. 9–13.

This minimum is chosen because the acceleration and deceleration of the pretest piston 216 (FIG. 2) make the plot of 308 (FIG. 3) reach a minimum at the piston's 216 maximum rate of travel, i.e., when acceleration equals zero. The in situ compressibility plot in FIG. 5(*b*) shows the $c_t$* as a maximum because the scales are reversed to provide easier visual interpretation. Further, if evolved gas enters the flowline, the compressibility curve will be an order of magnitude lower than what would be expected.

2. Real Time Permeability

The real time permeability is used to estimate the permeability during the buildup and to determine when the flowline storage and supercharging effects are influencing the pressure being measured by pressure sensor 216. As noted above, the real time permeability may be determined as a function of time, pressure, formation and fluid properties and $P_i$, the initial sandface pressure or the pressure derivative over time. The specific equations are set forth in the A4–5, Eq. 1 and 2, and A12–13, Eq. 14–20. In practice, both methods may be used to calculate real time compressibility $K_{rt}$ and, since they utilize differing inputs, $P_i$ and dP/dT, both methods act as a cross check.

If flowline storage were not affecting the pressure values obtained, the real time permeability curve FIG. 5(*d*) $K_{rt}$ obtained from Equations 1 and 2 would be a constant value and seen as a horizontal line. Alter flowline storage effects dissipate, the curve always transitions to a horizontal line, provided the flow is spherical. See FIG. 5(*d*). The presence of supercharging causes the real time permeability curve to never transition to a horizontal line. Since supercharging effects do not dissipate over time, it affects the values of P, $P_i$, as well as dP/dT. The effects of supercharging on real time permeability may be seen in FIG. 6(*d*). Supercharging appears as a sharp peak in the real time permeability.

One method used to determine initial sandface pressure $P_i$ is through the use of real time initial sandface pressure determinations. However, as noted earlier, flowline storage effects do not dissipate until the difference between the recorded pressure and the final buildup pressure is relatively small. This renders all of the initial buildup pressure data unusable. It will be appreciated that in tight zones, the buildup pressure time is even greater. The initial sandface pressure $P_i$ may be solved using A4, Eq. 1. Solving for pressure over time, Eq. 1 yields A5, Eq. 3. Equation 3 is the standard slope-intercept form of a straight line where the variable is $T^{(-1.5)}$, the P intercept being $P_i$. This equation may be used to generate FIG. 5(*c*) which is a plot of the real time initial sandface pressure. As plotted, as time increases, the curves in FIG. 5(*c*) move from right to left. While the initial pressure is never actually obtained, as this would require time to approach infinity, ta projection of the straight line to the pressure axis will yield an estimate of $P_i$.

It should be noted that the curves in FIG. 5(*c*) are not straight lines. This is due to the fact that the pressure values are influenced by flowline storage and supercharging as well as the spherical flow of fluid through the formation. Where supercharging is minimal, flowline storage is the only effect to be encountered. As shown in FIG. 5(*c*), the $P_i$ curves approach a straight line only after the difference between the recorded pressure and $P_i$ becomes very small.

The preferred embodiment, while capable of using real time initial sandface determination preferably utilizes the tight zone initial pressure determination, which will be discussed further below. The tight zone initial pressure determination allows the method of the preferred embodiment to determine the initial sandface pressure $P_i$ early during the buildup time period as opposed to the very end of the period using real time initial sandface pressure calculations.

3. Tight Zone Permeability

The tight zone permeability analysis is used to estimate the formation permeability during the early time buildup pressure cycle 310 (FIG. 3) which is relatively unaffected by flowline storage and supercharging effects. The tight zone permeability may also be utilized to estimate tight zone initial sandface pressure $P_i$ independent of flowline and supercharge effects. Since both of these may be determined early in the buildup cycle, the pressure transient testing may be terminated early during the test cycle.

The tight zone permeability estimate is based on the assumption that the majority of the fluid extracted from the formation actually occurs during the early buildup time, after piston 216 (FIG. 2) has stopped moving and is a result of the fluid decompression in the flowlines. Simulation of low permeability formations, using Halliburton's NEar Wellbore Simulator (NEWS) linked to the flow dynamics of a formation tester has shown this assumption to be valid.

Typical pressure buildup curves which are present in tight zones are illustrated in FIG. 5(*a*). The pressure drops rapidly during the drawdown phase and does not reach a steady-state condition. The pressure slowly builds at a steady rate for an extended period of time. Because the rate of change is slow, the instantaneous rate of flow at the sandface can be calculated by the rate of flowline decompression.

The tight zone analysis begins with the calculation of the instantaneous buildup flow rate. This estimate uses the in situ compressibility of the flow line fluid, $c_t$*, with the volume of the flowline and pretest chamber, $(V_{fl}+V_{pc})$, to determine the storage constant $c_t$* $(V_{fl}+V_{pc})$. The instantaneous rate of flow at the sandface during the initial buildup time is determine by multiplying the storage coefficient by the rate of pressure change (dP/dT). See A6, Eq. 4.

This instantaneous rate of flow function is then applied to an equation which sets forth the steady state spherical permeability equation, which is also a function of the initial sandface pressure. As noted above, the real time initial sandface pressure requires an extended period until the flow line effects dissipate. The method for estimating tight zone initial sandface pressures will be discussed below.

Since flowline storage characteristics are used in this calculation, the tight zone permeability $K_{tz}$ will be constant so long as flowline storage characteristics are present. (See A13–14, Eq. 21–37 for proof that $K_{tz}$ remains constant under such conditions). The tight zone permeability curves in FIG. 5(*f*) show a $K_{tz}$ reaching a constant value almost immediately. When compared with the real time permeability curves $K_{rt}$ of FIG. 5(*d*), it is apparent that $K_{tz}$ transitions to non-constant approximately the same time $K_{rt}$ begins a transition to the same horizontal value.

Therefore, as soon as the tight zone permeability curve, $K_{tz}$ versus time, transitions to a constant and maintains the same value for periods of tens of seconds, the test may be terminated and $K_{tz}$ read as a constant value. It will be appreciated that the tight zone permeability may thus be determined relatively early during the buildup cycle as opposed to waiting on the order of an hour when flowline storage effects finally dissipate.

4. Tight Zone Initial Sandface Pressure

As noted above, a determination of real time sandface initial pressure is affected by supercharging conditions throughout the test. (See FIG. 3, curve 305). The tight zone initial sandface pressure $P_i$ of the preferred embodiment is free of supercharging caused by additional seepage of fluid around the packer. The tight zone initial pressure is expressed as set forth in A6, Eq. 6 and 7.

By plotting pressure, P(T), as read by the formation tester sensor 216 (FIG. 2), against $e^{(-T/\alpha)}$ and by choosing a to make the curve a straight line for early time, $P_i$ can be readily determined. Even though a is a function of the tight zone permeability $K_{tz}$, $K_{tz}$ need not be known since the solution to a linear first order differential equation is unique and there can be only one $\alpha$ which satisfies the conditions. Thus it is not necessary to know $K_{tz}$ or any other of the parameters of $\alpha$. $P_i$ may best be determined using data for the time interval during which $K_{tz}$ is constant.

An alternative method for determining $P_i$ would be to plot P(T) against dP/dT and project the straight line to the vertical axis to obtain $P_i$ as the intercept (FIG. 7). This method requires that pressure data are obtained for which a good calculation of dP/dT maybe made. This method of obtaining tight zone initial pressures is preferred because $P_i$ can be determined early in the buildup cycle. For tight zones, the data quality of particular utility because the pressure sensor 216 (FIG. 2) is in its optimum dynamic response range. The pressure is changing at the best rate during the test and by amounts which do not push the resolution of the sensor.

It will be appreciated that the preferred embodiment focused on the use of the pretest chamber and flowline volumes to measure transient pressure response. The same general principles may be applied to formations having low permeabilities but nonetheless in excess of 1.0 millidarcies. Therein, the formation test chamber volumes may be used in conjunction with the pretest chamber volume to measure the fluid transient response within the tool. This would permit similar calculations to be made for low permeabilities in excess of 1.0 millidarcies.

Thus, the method of the preferred embodiment permits a determination of initial sandface pressure and formation permeability in tight zones early during the test cycle. This early determination results in improved tool utilization, lower test cycle time and reduced rig time.

While the above represents the preferred embodiment of the present invention, it will be apparent to those skilled in the art that various changes and modifications may be made herein without departing from the scope of the invention as claimed.

We claim:

1. A method for real-time determination of permeability of an earth formation traversed by a well borehole, said formation having a permeability in the range of approximately 0.001 to 1.000 millidarcies, the steps comprising:

(a) disposing a formation tester in said well borehole, said formation tester including formation fluid communications means, a pretest chamber and piston, said piston being disposed and reciprocally moveable within said pretest chamber, pressure and flow measurement means, and flowlines in communication with said fluid communications means, prestest chamber, pressure and flow measurement means and sample chamber;

(b) establishing fluid communications between said tester and the earth formation;

(c) drawing earth formation fluid into said fluid communications means, flowlines and prestest chamber for a first time period by inducing a pressure differential between said tester and the formation and measuring pressure of said fluid over said first time period;

(d) calculating fluid in situ compressibility at the end of said first time period as a function of the volume of fluid in communication with said pretest chamber and flowlines and a fluid pressure time differential during said first time period;

(e) terminating said induced pressure differential and continuing to measure pressure for a second, indeterminate, time period;

(f) calculating and plotting real time formation permeability during said second time period;

(g) calculating and plotting tight zone formation permeability during said second time period;

(h) calculating and plotting tight zone initial sandface pressure during said second time period;

(i) continuing to perform steps (f) through (h) until a predetermined criteria is met; and (j) recording tight zone formation permeability and initial sandface pressure when said predetermined criteria is met.

2. The method of claim 1, wherein the step of inducing a pressure differential between said tester and the earth formation includes indexing said pretest chamber piston to increase the pretest chamber volume, thereby creating a negative pressure differential relative to the earth formation.

3. The method of claim 1, wherein the step of calculating fluid in situ compressibility ($c_t$*) includes calculating compressibility according to the following equation:

$$c_t^* = \frac{V_{pc}}{V_{fl}(T_{start} - T_{dd})\left(\frac{\Delta P}{\Delta T}\right)}$$

where, $T_{start}$ and $T_{dd}$ represent the beginning and end of the first time period, $V_{fl}$ and $V_{pc}$ represent the volume of fluid in the flowlines and pretest chamber, respectively, and $\Delta P/\Delta T$ is the change in pressure over time.

4. The method of claim 1, wherein the step of drawing earth formation fluid into said fluid communications means by inducing a pressure differential, includes the step of indexing said pretest piston within said pretest chamber to increase the volume of said pretest chamber, thereby decreasing the pressure within the fluid communications means, pretest chamber and flowlines relative to the earth formation.

5. The method of claim 1, wherein the step of calculating and plotting real time formation permeability ($K_{rt}$) includes calculating said permeability according to the following equation:

$$K_{rt}=\frac{C_{rt}}{T}\left(\frac{1}{P_i-P}\right)^{\frac{1}{1.5}}$$

where T is time in said second period, $P_i$ is an estimate of tight zone initial sandface pressure and $C_{rt}$ is a real time compressibility constant coefficient.

6. The method of claim 1, wherein the step of calculating and plotting real time formation permeability ($K_{rt}$) includes calculating said permeability as a function of time according to the following equation:

$$K_{rt}=C_{rt}\left(\frac{1.5}{T^{2.5}\left|\frac{dP}{dT}\right|}\right)^{\frac{1}{1.5}}$$

where T is time during said second period, $C_{rt}$ is the real time compressibility constant coefficient and dP/dT is the pressure—time differential.

7. The method of claim 1, wherein the step of calculating and plotting tight zone permeability includes calculating the instantaneous rate of flow at the sandface during said second time period, as a function of time based on the in situ compressibility, the volume of fluid in the flowlines and pretest chamber, and the rate of pressure change within said flowlines and pretest chamber.

8. The method of claim 7, wherein the step of calculating the instantaneous rate of flow at the sandface includes calculating said rate of flow as a function of time ($q_{bu}(T)$) according to the following equation:

$$q_{bu}(T)=c_t*(V_{fl}+V_{pc})\left(\frac{dP}{dT}\right),$$

where $V_{fl}$ and $V_{pc}$ represent the volume of fluid in the flowlines and pretest chamber, respectively and dP/dT is the pressure-time differential.

9. The method of claim 8, wherein the tight zone permeability ($K_{tz}$) is calculated and plotted against time according to the following equation:

$$K_{tz}=\left(\frac{14696}{2\pi}\right)\left(\frac{q_{bu}(T)\mu}{r_p(P_i-P(T))}\right),$$

where $\mu$ is an estimated fluid viscosity constant, $r_p$ is the radius of said fluid communications means, and $P_i$ is a calculated initial sandface pressure.

10. The method of claim 9, wherein the step of calculating and plotting the initial sandface pressure includes simultaneously satisfying the equation for tight zone permeability and the following equation:

$$P(T)=P_i-\left(\frac{V_{pc}}{C_tV_{fl}}\right)e^{\left(\frac{-T}{\alpha}\right)},$$

where T is time during said second time period, $C_t$ is a compressibility constant coefficient and $\alpha$ is defined as follows:

$$\alpha=\left(\frac{14696}{2\pi}\ \frac{\mu}{r_pK_{tz}}\right)c_t(V_{fl}+V_{pc}),$$

and $c_t$ is the compressibility of the fluid.

11. The method of claim 1, wherein said predetermined criteria includes observing the real time permeability plot maintaining an approximately constant value for a predetermined time period.

12. The method of claim 11, wherein said predetermined time period is approximately 100–200 seconds.

13. A real-time method for determining permeability of an earth formation traversed by a well borehole, the steps comprising:

(a) disposing a formation tester in said well borehole, said formation tester including formation fluid communications means, a pretest chamber and piston, said piston being disposed and reciprocally moveable within said pretest chamber thereby varying the volume of said pretest chamber, at least one sample chamber, pressure measurement means, and flowlines in communication with said fluid communications means, pretest chamber, pressure measurement means and sample chamber;

(b) initiating a formation test by establishing fluid communications between said tester and the earth formation;

(c) drawing earth formation fluid into said fluid communications means, flowlines and pretest chamber for a first time period, $T_{start}$ to $T_{dd}$, by inducing a pressure differential between said tester and a earth formation and measuring the change in pressure of said fluid over said first time period;

(d) calculating fluid in situ compressibility at the end of said first time period as a function of the volume of fluid in communication with said pretest chamber and flowlines and the fluid pressure time differential during said first time period;

(e) terminating said induced pressure differential and continuing to measure the pressure of said fluid for a second, indeterminate time period;

(f) calculating and plotting real time formation permeability during said second time period;

(g) calculating and plotting tight zone formation permeability during said second time period;

(h) calculating and plotting tight zone initial sandface pressure during said second time period;

(i) terminating said test when a predetermined criteria has been met; and (j) recording the initial sandface pressure and the formation permeability.

14. The method of claim 13, wherein the step of terminating said test when said predetermined criteria has been met includes observing the real time permeability plot maintaining an approximately constant value for a predetermined time period.

15. The method of claim 14, wherein the step of recording the initial sandface pressure and formation permeability plot includes recording the value of said tight zone initial sandface pressure and said tight zone permeability.

16. The method of claim 14, wherein said predetermined time period is approximately 100–200 seconds.

17. The method of claim 13, wherein the step of terminating said test includes observing an approximately constant fluid pressure value for a predetermined period of time.

18. The method of claim 13, wherein the step of calculating fluid in situ compressibility ($c_t$*) includes calculating compressibility according to the following equation:

$$c_t^* = \frac{V_{pc}}{V_{fl}(T_{start} - T_{dd})\left(\frac{\Delta P}{\Delta T}\right)}$$

where $V_{fl}$ and $V_{pc}$ represent the volume of fluid in the flowlines and pretest chamber, respectively, and $\Delta P/\Delta T$ is the change in pressure—time differential.

19. The method of claim 13, wherein the step of drawing formation fluid into said fluid communications means by inducing a pressure differential, includes the step of indexing said pretest piston within said pretest chamber to increase the volume of said pretest chamber, thereby decreasing the pressure within the fluid communications means, pretest chamber and flowlines relative to the earth formation.

20. The method of claim 13, wherein the step of calculating and plotting real time formation permeability ($K_{rt}$) includes calculating said permeability according to the following equation:

$$K_{rt} = \frac{C_{rt}}{T}\left(\frac{1}{P_i - P}\right)^{\frac{1}{1.5}}$$

where $P_i$ is an estimate of tight zone initial sandface pressure and $C_{rt}$ is a real time compressibility constant coefficient.

21. The method of claim 13, wherein the step of calculating and plotting real time formation permeability ($K_{rt}$) includes calculating said permeability as a function of time according to the following equation:

$$K_{rt} = C_{rt}\left(\frac{1.5}{T^{2.5}\left|\frac{dP}{dT}\right|}\right)^{\frac{1}{1.5}}$$

where $C_{rt}$ is the real time compressibility constant coefficient and dP/dT is the pressure—time differential.

22. The method of claim 13, wherein the step of calculating the instantaneous rate of flow at the sandface includes calculating said rate of flow (qbu(T))according to the following equation:

$$q_{bu}(T) = c_t * (V_{fl} + V_{pc})\left(\frac{dP}{dT}\right),$$

where $V_{fl}$ and $V_{pc}$ represent the volume of fluid in the flowlines and pretest chamber, respectively, and dP/dT is the pressure-time differential.

23. The method of claim 22, wherein the tight zone permeability ($K_{tz}$) is calculated and plotted against time according to the following equation:

$$K_{tz} = \left(\frac{14696}{2\pi}\right)\left(\frac{q_{bu}(T)\mu}{r_p(P_i - P(T))}\right),$$

where $\mu$ is an estimated fluid viscosity constant, $r_p$ is the radius of said fluid communications means, and $P_i$ is a calculated initial sandface pressure.

24. The method of claim 23, wherein the step of calculating and plotting the initial sandface pressure includes simultaneously solving for tight zone permeability and the following equation:

$$P(T) = P_i - \left(\frac{V_{pc}}{C_t V_{fl}}\right) e^{\left(\frac{-T}{\alpha}\right)},$$

where $C_t$ is a compressibility constant coefficient and $\alpha$ is defined as follows:

$$\alpha = \left(\frac{14696}{2\pi}\ \frac{\mu}{r_p K_{tz}}\right) c_t(V_{fl} + V_{pc}),$$

and $c_t$ is the compressibility of the fluid.

25. The method of claim 24, wherein the method of determining tight zone initial sandface pressure includes the steps of:

(a) plotting P(T) against dP/dT; and (b) projecting a straight line to the pressure axis of said plot to obtain an initial value $P_i$.

26. A method for real-time determination of permeability of an earth formation traversed by a well borehole in the presence of supercharge and flowline storage effects, the steps comprising:

disposing a formation tester in said well borehole, said formation tester including formation fluid communications means, a pretest chamber and piston, said piston being disposed and reciprocally moveable within said pretest chamber, at least one sample chamber, pressure measurement means, and flowlines in communication with said fluid communications means, pretest chamber, pressure measurement means and sample chamber;

drawing fluid from said earth formation for a first time period by inducing a pressure differential relative to said earth formation for a first period of time, $T_{start}$ to $T_{dd}$, and measuring the pressure of said fluid with respect to time;

terminating said induced pressure differential and continuing to draw earth formation fluid and continuing to measure the pressure of said fluid with respect to time;

calculating in situ formation compressibility following termination of said induced pressure differential; and calculating earth formation pressure and permeability in the presence of supercharge and flowline storage pressure effects prior to said measured pressure of said fluid approximating a straight line function with respect to time.

27. The method of claim 26, further including the step of plotting said measured pressure, formation permeability and formation pressure as a function of time.

28. The method of claim 26, wherein the step of calculating in situ formation compressibility ($c_t^*$) includes calculation according to the following equation:

$$c_t^* = \frac{V_{pc}}{V_{fl}(T_{start} - T_{dd})\left(\frac{\Delta P}{\Delta T}\right)}$$

where $T_{start}$ and $T_{dd}$ are the beginning and end of said first time period, $V_{fl}$ and $V_{pc}$ represent the volume of fluid in the flowlines and pretest chamber, respectively, and $\Delta P/\Delta T$ is the change in pressure over time.

29. The method of claim 28, further including the step of determining instantaneous rate of flow ($q_{bu}(T)$) as a function of in situ compressibility according to the following equation:

$$q_{bu}(T) = c_t * (V_{fl} + V_{pc})\left(\frac{dP}{dT}\right),$$

where $V_{fl}$ and $V_{pc}$ represent the volume of fluid in the flowlines and pretest chamber, respectively and dP/dT is the pressure-time differential.

30. The method of claim 29, further including the step of calculating a tight zone permeability ($K_{tz}$), according to the following equation:

$$K_{tz} = \left(\frac{14696}{2\pi}\right)\left(\frac{q_{bu}(T)\mu}{r_p(P_i - P(T))}\right),$$

where $\mu$ is an estimated fluid viscosity constant, $r_p$ is the radius of said fluid communications means, and $P_i$ is a calculated initial sandface pressure.

31. The method of claim 30, wherein the step of calculating formation pressure ($P_i$) includes simultaneously solving for tight zone permeability and the following equation:

$$P(T) = P_i - \left(\frac{V_{pc}}{C_t V_{fl}}\right) e^{\left(\frac{-T}{\alpha}\right)},$$

where $C_t$ is a compressibility constant coefficient and $\alpha$ is defined as follows:

$$\alpha = \left(\frac{14696}{2\pi} \quad \frac{\mu}{r_p K_{tz}}\right) c_t(V_{fl} + V_{pc}),$$

and ct is the compressibility of the fluid.

32. The method of claim 26, wherein the step of calculating earth formation permeability includes calculating real time formation permeability ($K_{rt}$) according to the following equation:

$$K_{rt} = \frac{C_{rt}}{T}\left(\frac{1}{P_i - P}\right)^{\frac{1}{1.5}}$$

where T is time during said second period, $P_i$ is an estimate of tight zone initial sandface pressure and $C_{rt}$ is a real time compressibility constant coefficient.

33. The method of claim 26, wherein the step of calculating earth formation permeability includes calculating real time formation permeability ($K_{rt}$) according to the following equation:

$$K_{rt} = C_{rt}\left(\frac{1.5}{T^{2.5}\left|\frac{dP}{dT}\right|}\right)^{\frac{1}{1.5}}$$

where T is time during said second period, $C_{rt}$ is the real time compressibility constant coefficient and dP/dT is the pressure—time differential.

* * * * *